US011424536B2

(12) United States Patent
Koshi et al.

(10) Patent No.: US 11,424,536 B2
(45) Date of Patent: Aug. 23, 2022

(54) MULTIBAND COMPATIBLE ANTENNA AND RADIO COMMUNICATION DEVICE

(71) Applicant: Panasonic Intellectual Property Management Co., Ltd., Osaka (JP)

(72) Inventors: Masashi Koshi, Ishikawa (JP); Takahiro Ochi, Miyagi (JP); Shingo Sumi, Miyagi (JP); Kenji Nishikawa, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 106 days.

(21) Appl. No.: 16/744,026

(22) Filed: Jan. 15, 2020

(65) Prior Publication Data

US 2020/0153097 A1 May 14, 2020

Related U.S. Application Data

(63) Continuation of application No. PCT/JP2018/026682, filed on Jul. 17, 2018.

(30) Foreign Application Priority Data

Jul. 20, 2017 (JP) ..... JP2017-140847

(51) Int. Cl.
*H01Q 5/30* (2015.01)
*H01Q 13/10* (2006.01)
*H01Q 1/48* (2006.01)

(52) U.S. Cl.
CPC ..... *H01Q 5/30* (2015.01); *H01Q 13/10* (2013.01); *H01Q 1/48* (2013.01)

(58) Field of Classification Search
CPC ..... H01Q 5/30; H01Q 5/357; H01Q 5/364; H01Q 5/371; H01Q 13/10; H01Q 13/106;
(Continued)

(56) References Cited

U.S. PATENT DOCUMENTS 9,099,789 B1 * 8/2015 Modro ..... H01Q 1/48
2002/0060644 A1 * 5/2002 Talvitie ..... H01Q 9/0442 343/700 MS (Continued)

FOREIGN PATENT DOCUMENTS

JP 2005-203878 A 7/2005
JP 2007-088975 A 4/2007
JP 4864733 B2 2/2012

OTHER PUBLICATIONS

International Search Report issued in corresponding International Patent Application No. PCT/JP2018/026682, dated Oct. 9, 2018, with English translation.

*Primary Examiner* — Hoang V Nguyen
(74) *Attorney, Agent, or Firm* — McDermott Will & Emery LLP

(57) ABSTRACT

A multiband compatible antenna that resonates at a first frequency and a second frequency includes: a planar conductor including a feeding portion to which a signal is supplied, a grounding portion, and a slit between the feeding portion and grounding portion. The slit includes a first slit portion extending in a first direction and a second slit portion extending in a second direction intersecting the first direction from an end of the first slit portion. The first slit portion is disposed closer to one edge than a center of the planar conductor in the second direction, and the feeding portion is disposed to a side of the first slit portion closer to the one edge. The planar conductor includes a first element portion and a second frequency portion that resonate at the first frequency and the second frequency, respectively. The second slit portion is disposed in the first element portion.

17 Claims, 14 Drawing Sheets

(58) Field of Classification Search
CPC .... H01Q 13/085; H01Q 13/16; H01Q 5/0058; H01Q 1/48; H01Q 1/243; H01Q 9/42; H01Q 5/378
See application file for complete search history.

(56) References Cited

U.S. PATENT DOCUMENTS

| | | | | |
|---|---|---|---|---|
| 2004/0085244 | A1* | 5/2004 | Kadambi | H01Q 9/0421 343/700 MS |
| 2005/0093749 | A1* | 5/2005 | Purr | H01Q 9/0407 343/702 |
| 2005/0153756 | A1 | 7/2005 | Sato et al. | |
| 2008/0165065 | A1* | 7/2008 | Hill | H01Q 1/243 343/702 |
| 2008/0169981 | A1 | 7/2008 | Hotta et al. | |
| 2009/0256757 | A1* | 10/2009 | Chiang | H01Q 13/10 343/702 |
| 2010/0019976 | A1* | 1/2010 | Sakiyama | H01Q 9/0442 343/700 MS |
| 2010/0245197 | A1* | 9/2010 | Kerselaers | H01Q 13/085 343/767 |
| 2012/0218163 | A1* | 8/2012 | Wong | H01Q 5/378 343/843 |
| 2013/0050036 | A1* | 2/2013 | Kashiwagi | H01Q 5/321 343/749 |

* cited by examiner

MULTIBAND COMPATIBLE ANTENNA AND RADIO COMMUNICATION DEVICE

CROSS REFERENCE TO RELATED APPLICATIONS

This application is a U.S. continuation application of PCT International Patent Application Number PCT/JP2018/026682 filed on Jul. 17, 2018, claiming the benefit of priority of Japanese Patent Application Number 2017-140847 filed on Jul. 20, 2017, the entire contents of which are hereby incorporated by reference.

BACKGROUND

1. Technical Field

The present disclosure relates to a multiband compatible antenna and a radio communication device including the multiband compatible antenna.

2. Description of the Related Art

Conventionally, antennas that are compatible with multiband are known (see, for example, Japanese Patent No. 4864733 and Japanese Unexamined Patent Application Publication No. 2005-203878). Japanese Patent No. 4864733 and Japanese Unexamined Patent Application Publication No. 2005-203878 each disclose an antenna device equipped with two folded monopole antennas. The antenna device disclosed in each of Japanese Patent No. 4864733 and Japanese Unexamined Patent Application Publication No. 2005-203878 is trying to embody an antenna device that can cope with multiband with a simple configuration.

SUMMARY

The present disclosure provides a small multiband compatible antenna with high radiation efficiency and a radio communication device including the multiband compatible antenna.

A multiband compatible antenna according to an aspect of the present disclosure is a multiband compatible antenna that resonates at a first frequency and a second frequency higher than the first frequency, and includes: a planar conductor including a feeding portion to which a signal is supplied, a grounding portion which is grounded, and a slit disposed between the feeding portion and the grounding portion, wherein the slit includes a first slit portion extending in a first direction and a second slit portion extending in a second direction intersecting with the first direction from an end of the first slit portion, the first slit portion is disposed at a position closer to one edge than a center of the planar conductor in the second direction, the feeding portion is disposed to a side of the first slit portion that is closer to the one edge, the planar conductor includes a first element portion that resonates at the first frequency and a second element portion that resonates at the second frequency, and the second slit portion is disposed in the first element portion.

A multiband compatible antenna and radio communication device including the multiband compatible antenna according to the present disclosure are effective for achieving miniaturization and high radiation efficiency.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DETAILED DESCRIPTION OF THE EMBODIMENTS (Underlying Knowledge Forming the Basis of the Disclosure)

Prior to the description of embodiments of the present disclosure, first the knowledge that forms the basis of the present disclosure will be described.

Figure 33:
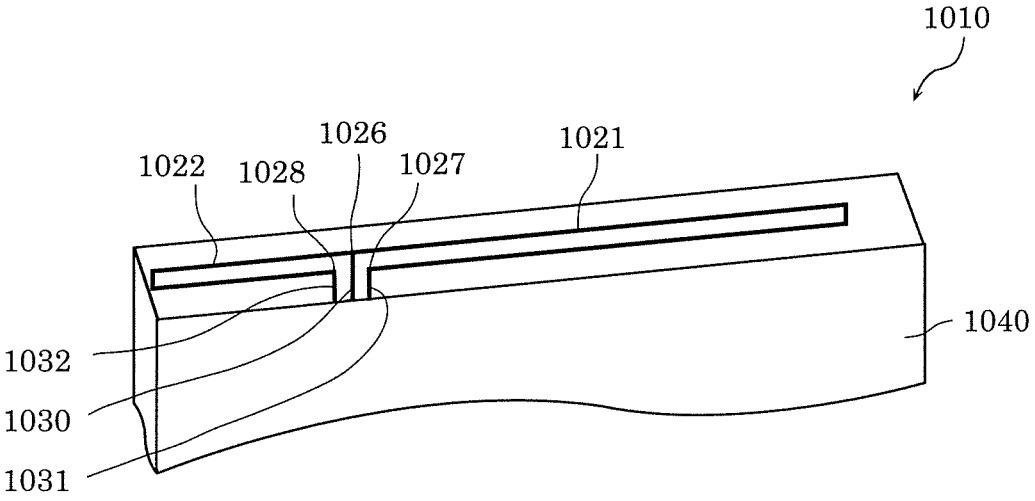
FIG. 33 is a perspective view illustrating the shape of a multiband compatible antenna of comparative example 1.

FIG. 33 is a perspective view illustrating the shape of multiband compatible antenna 1010 of comparative example 1. Multiband compatible antenna 1010 according to comparative example 1 has the same configuration as the antenna device disclosed in Japanese Patent No. 4864733 and resonates at a first frequency and a second frequency. As illustrated in FIG. 33, multiband compatible antenna 1010 includes first element portion 1021, second element portion 1022, feeding element 1030, short circuit element 1031 and short circuit element 1032, and chassis 1040. In addition, multiband compatible antenna 1010 includes feeding portion 1026 and grounding portion 1027 and grounding portion 1028. Feeding portion 1026 is disposed at a connection point of first element portion 1021 and second element portion 1022. Grounding portion 1027 and grounding portion 1028 are disposed at ends of first element portion 1021 and second element portion 1022 opposite to an end where feeding portion 1026 is disposed, respectively. Feeding element 1030 is connected to feeding portion 1026 and supplies a signal supplied from the outside of multiband compatible antenna 1010 to multiband compatible antenna 1010. Short circuit element 1031 and short circuit element 1032 short-circuit first element portion 1021 and second element portion 1022 to chassis 1040 formed of a conductive material, respectively.

First element portion 1021 and second element portion 1022 are antennas that resonate at the first frequency and the second frequency, respectively. In comparative example 1, first element portion 1021 and second element portion 1022 are each a folded monopole antenna. The lengths of first element portion 1021 and second element portion 1022 in the longitudinal direction are 87 mm and 35 mm, respectively. The first frequency and the second frequency are approximately 0.8 GHz and approximately 1.95 GHz, respectively. The same applies to the first frequency and the second frequency in the following comparative examples.

Figure 34:
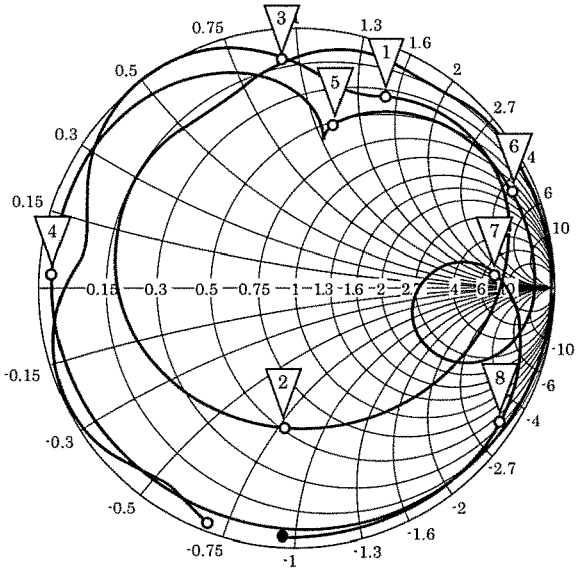
FIG. 34 is a Smith chart illustrating the frequency characteristics of the impedance of the multiband compatible antenna of comparative example 1.
Figure 35:
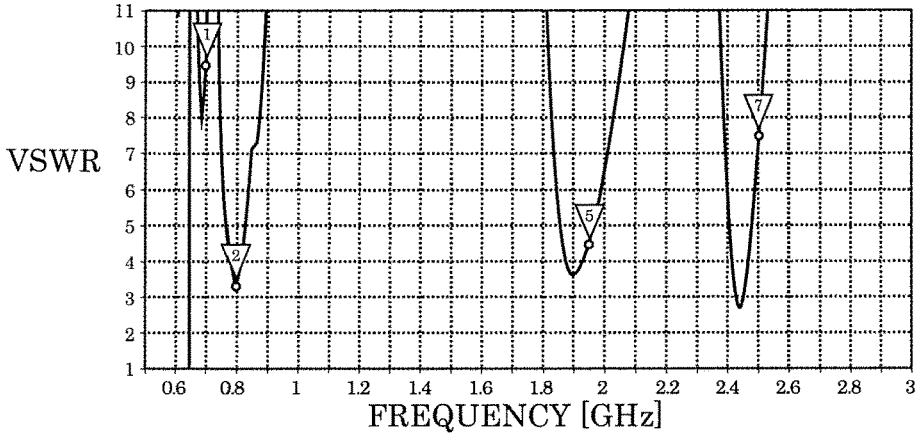
FIG. 35 is a graph illustrating the frequency characteristics of the voltage standing wave ratio of the multiband compatible antenna of comparative example 1.

Here, the frequency characteristics of multiband compatible antenna 1010 will be described with reference to drawings. FIG. 34 is a Smith chart illustrating the frequency characteristics of the impedance of multiband compatible antenna 1010 of comparative example 1. FIG. 34 illustrates the locus of the impedance when the frequency of a signal supplied to multiband compatible antenna 1010 is changed. Note that similar loci are illustrated in Smith charts shown below. FIG. 35 is a graph illustrating the frequency characteristics of the voltage standing wave ratio (VSWR) of multiband compatible antenna 1010 of comparative example 1. FIG. 34 and FIG. 35 both illustrate data obtained by simulation. Note that the point indicated by each triangle illustrated in FIG. 34 corresponds to the point indicated by each triangle illustrated in FIG. 35. For example, the point indicated by the triangle marked with numeric character 1 in FIG. 34 corresponds to the point indicated by the triangle marked with numeric character 1 in FIG. 35 and the points indicate the impedance and the VSWR, respectively, when the frequency is 0.7 GHz. The same applies to points indicated by triangles marked with other numeric characters. Also, the same applies to other Smith charts and graphs shown below.

As illustrated in FIG. 34 and FIG. 35, multiband compatible antenna 1010 can resonate at the first frequency and the second frequency but bandwidth where resonance can occur is narrow.

Next, a multiband compatible antenna of comparative example 2 will be described. The multiband compatible antenna of comparative example 2 is different from the multiband compatible antenna of comparative example 1 in the widths of the first element portion and the second element portion and in the configuration of the grounding portion. Hereinafter, the multiband compatible antenna of comparative example 2 will be described with reference to drawings mainly focusing on the difference.

Figure 36:
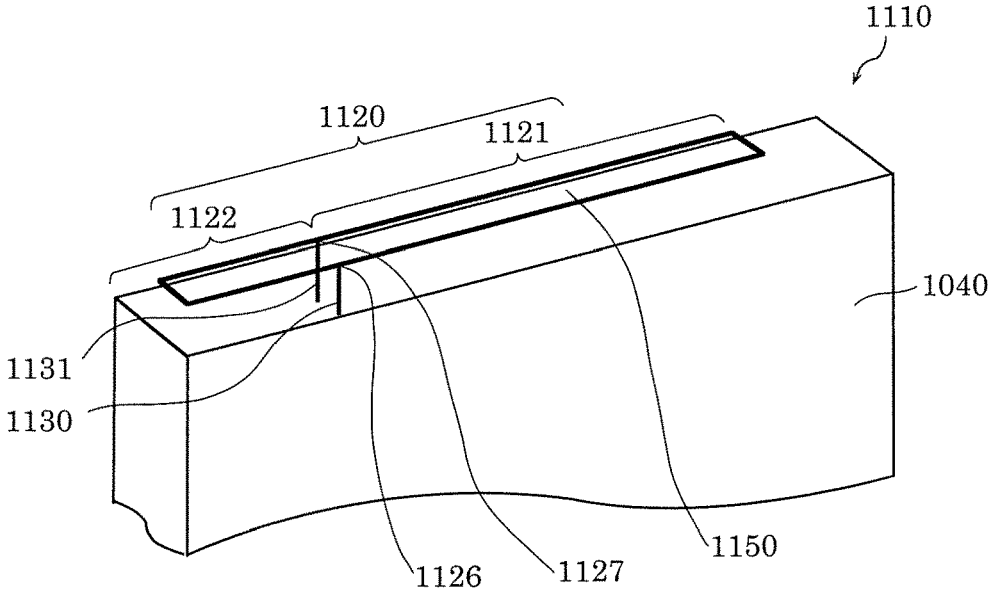
FIG. 36 is a perspective view illustrating the shape of a multiband compatible antenna of comparative example 2.

FIG. 36 is a perspective view illustrating the shape of multiband compatible antenna 1110 of comparative example 2. Multiband compatible antenna 1110 of comparative example 2 has the same configuration as the antenna device disclosed in Japanese Unexamined Patent Application Publication No. 2005-203878 and resonates at the first frequency and the second frequency. As illustrated in FIG. 36, multiband compatible antenna 1110 includes conductor 1120, feeding element 1130, short circuit element 1131, and chassis 1040. Conductor 1120 is a long wire-like conductor and has slit 1150 formed along the longitudinal direction. Conductor 1120 includes first element portion 1121 and second element portion 1122 that resonate at the first frequency and the second frequency, respectively. The lengths of first element portion 1121 and second element portion 1122 in the longitudinal direction are 81 mm and 29 mm, respectively, and the lengths in the short side direction are 10 mm. Conductor 1120 is spaced apart from chassis 1040 by 10 mm.

Conductor 1120 includes feeding portion 1126 and grounding portion 1127. Feeding portion 1126 is disposed at one connection point of first element portion 1121 and second element portion 1122. Grounding portion 1127 is disposed at the other connection point of first element portion 1121 and second element portion 1122. Feeding element 1130 is connected to feeding portion 1126 and supplies a signal supplied from the outside of multiband compatible antenna 1110 to multiband compatible antenna 1110. Short circuit element 1131 is connected to grounding portion 1127 and short-circuits first element portion 1121 and second element portion 1122 to chassis 1040.

Figure 37:
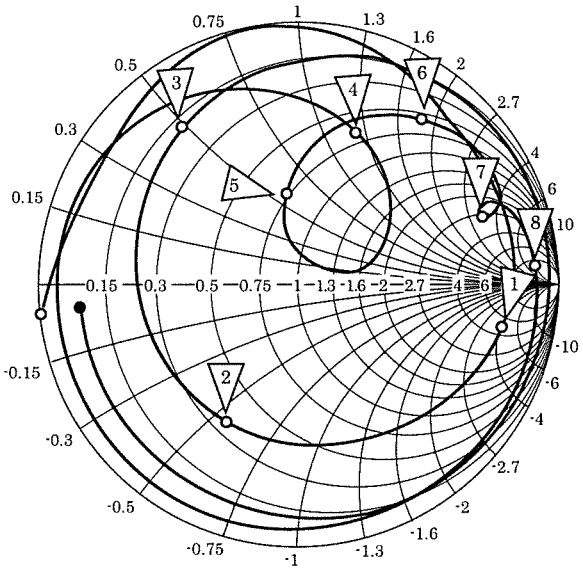
FIG. 37 is a Smith chart illustrating the frequency characteristics of the impedance of the multiband compatible antenna of comparative example 2.
Figure 38:
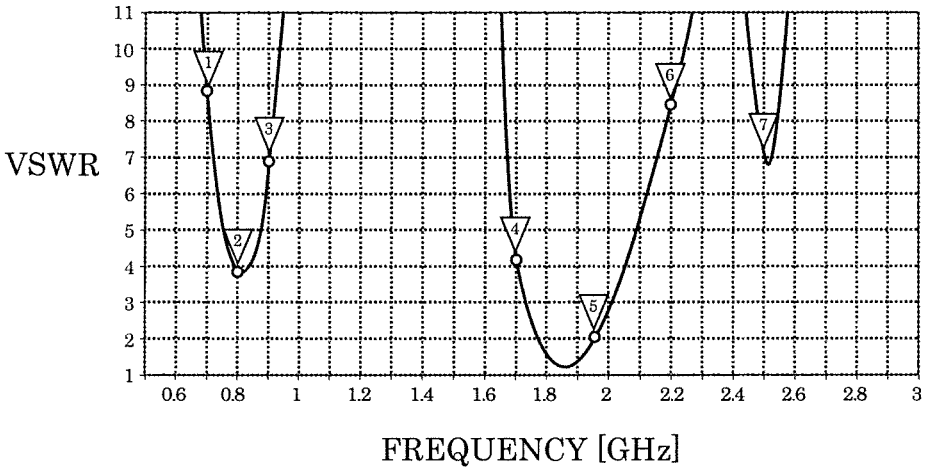
FIG. 38 is a graph illustrating the frequency characteristics of the voltage standing wave ratio of the multiband compatible antenna of comparative example 2.

Here, the frequency characteristics of multiband compatible antenna 1110 will be described with reference to drawings. FIG. 37 is a Smith chart illustrating the frequency characteristics of the impedance of multiband compatible antenna 1110 of comparative example 2. FIG. 38 is a graph illustrating the frequency characteristics of the voltage standing wave ratio of multiband compatible antenna 1110 of comparative example 2.

As illustrated in FIG. 37 and FIG. 38, multiband compatible antenna 1110 can resonate at the first frequency and the second frequency and can widen resonance frequency bandwidth as compared to multiband compatible antenna 1010 of comparative example 1. This is considered to be because the effect of grounding conductor 1120 which is an antenna element to the ground is increased without antenna current being distributed as a result of the arrangement positions of the short circuit elements being concentrated from two places to one.

As described above, although each of the multiband compatible antennas of the comparative examples can resonate at at least one of the first frequency or the second frequency, the present disclosure provides a small multiband compatible antenna with high radiation efficiency and a radio communication device including the multiband compatible antenna.

Hereinafter, embodiments will be described in detail with reference to drawings as appropriate. However, detailed descriptions more than necessary may be omitted. For example, detailed descriptions of already well known matters or repeated descriptions of substantially the same configuration may be omitted. This is to avoid the following description from becoming unnecessarily redundant and to facilitate understanding by those skilled in the art.

Note that the inventors provide the accompanying drawings and the following description in order for those skilled in the art to fully understand the present disclosure and it is not intended to limit the subject matter described in the claims by them.

Embodiment 1

A multiband compatible antenna according to Embodiment 1 will be described.

[1-1. Overall Configuration]

The overall configuration of the multiband compatible antenna according to the embodiment will be described with reference to drawings.

Figure 1:
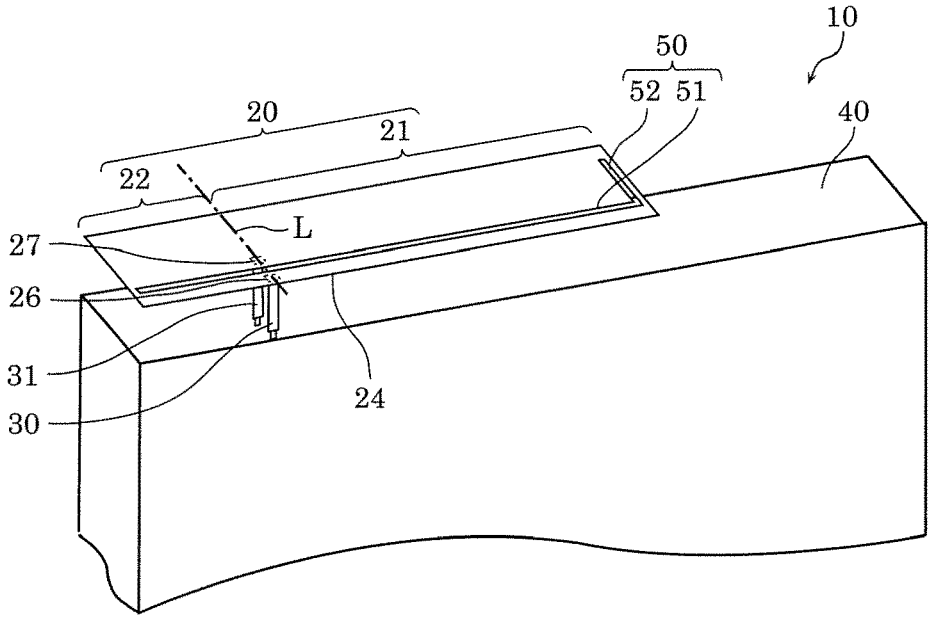
FIG. 1 is a perspective view illustrating an appearance of a multiband compatible antenna according to Embodiment 1.

FIG. 1 is a perspective view illustrating an appearance of multiband compatible antenna 10 according to the embodiment.

Multiband compatible antenna 10 according to the embodiment resonates at a first frequency and a second frequency higher than the first frequency. Although the first frequency and the second frequency are not specifically limited, for example, they are approximately 0.8 GHz and approximately 1.95 GHz, respectively. The same applies to the first frequency and the second frequency in the following embodiments. As illustrated in FIG. 1, multiband compatible antenna 10 includes planar conductor 20, feeding element 30, short circuit element 31, and chassis 40.

Planar conductor 20 is a planar conductor that includes feeding portion 26 to which a signal is supplied and grounding portion 27 which is grounded, and has slit 50 formed between feeding portion 26 and grounding portion 27. In the embodiment, planar conductor 20 has a substantially rectangular planar shape. For example, planar conductor 20 may be formed of metal foil such as copper foil printed on an insulating substrate or may be formed of a thin plate-like conductor. In the present specification, the term "planar" means a sheet-like or film-like shape in which the length in the short direction (that is, the width direction) with respect to the length in the longitudinal direction is at least 1/10 and at most 1/2.

Slit 50 includes first slit portion 51 extending in a first direction and second slit portion 52 extending in a second direction intersecting with the first direction from an end of first slit portion 51. First slit portion 51 is disposed at a position closer to one edge 24 than the center of planar conductor 20 in the second direction, and feeding portion 26 is disposed at the one edge 24-side relative to first slit portion 51. Planar conductor 20 includes first element portion 21 extending toward one side from straight line L passing through feeding portion 26 and grounding portion 27 and second element portion 22 extending toward the other side from the straight line, and second slit portion 52 is disposed in first element portion 21. The distance between first slit portion 51 and edge 24 may be set as appropriate, and is approximately 3 mm in the embodiment. The distance between second slit portion 52 and the edge of first element portion 21 in the first direction is approximately 1 mm. Note that in the embodiment, although first slit portion 51 is disposed at a position closer to one edge 24 than the center in the second direction over the whole length, the configuration of first slit portion 51 is not limited to this. It is sufficient that first slit portion 51 be disposed at a position closer to one edge 24 than the center in the second direction in at least part of first element portion 21.

The electrical length of slit 50 in first element portion 21 is at least 0.15 times and at most 0.35 times the effective wavelength corresponding to the first frequency, and the electrical length of the slit in second element portion 22 is at least 0.15 times and at most 0.35 times the effective wavelength corresponding to the second frequency. More preferably, the electrical length of slit 50 in first element portion 21 is at least 0.20 times and at most 0.30 times the effective wavelength corresponding to the first frequency, and the electrical length of the slit in second element portion 22 is at least 0.2 times and at most 0.30 times the effective wavelength corresponding to the second frequency. That is, the electrical length of the slit in first element portion 21 is approximately a quarter of the effective wavelength corresponding to the first frequency. In this case, because the electrical length of a path from feeding portion 26 to grounding portion 27 in first element portion 21 is approximately a half of the effective wavelength corresponding to the first frequency, resonance at the first frequency is obtained in first element portion 21. In the same manner, because the electrical length of a path from feeding portion 26 to grounding portion 27 in second element portion 22 is approximately a half of the effective wavelength corresponding to the second frequency, resonance at the second frequency is obtained in second element portion 22. In the embodiment, slit 50 has an L-shape, thereby the length of the planar conductor in the direction along slit 50 is reduced as compared to the planar conductor in each of the above comparative examples, and resonance can be obtained at frequencies similar to the multiband compatible antenna of each of the above comparative examples. That is, the embodiment can miniaturize multiband compatible antenna 10.

Furthermore, in the embodiment, the electrical length of slit 50 in first element portion 21 is at least 0.4 times and at most 0.6 times the effective wavelength corresponding to the second frequency. Thereby, resonance not only at the first frequency but also at the second frequency is obtained in first element portion 21. For this reason, a resonance frequency band including the second frequency can be widened.

In the embodiment, the lengths of first element portion 21 and second element portion 22 in the first direction are 67 mm and 22 mm, respectively, and the lengths of first element portion 21 and second element portion 22 in the second direction are 25 mm.

The width of slit 50 is not specifically limited, and it is sufficient to be, for example, at least 0.5 mm and at most 3 mm.

Feeding element 30 is an element that is connected to feeding portion 26 and supplies a signal to planar conductor 20. In the embodiment, feeding element 30 is connected to a signal source (not illustrated) outside multiband compatible antenna 10 via a matching circuit. More specifically, feeding element 30 electrically connects one of two terminals of the signal source to feeding portion 26 and the other to chassis 40. Thereby, the signal can be supplied from the signal source to feeding portion 26. Feeding element 30 is formed of a conductive material, for example, aluminum or copper. The shape of feeding element 30 is not specifically limited, but in the embodiment, feeding element 30 has a long plate-like shape.

Short circuit element 31 is a conductive element that short-circuits grounding portion 27 and chassis 40. Short circuit element 31 is formed of a conductive material, for example, aluminum or copper. The shape of short circuit element 31 is not specifically limited, but in the embodiment, short circuit element 31 has a long plate-like shape.

At least one of feeding element 30 or short circuit element 31 may be fixed to chassis 40 and support planar conductor 20. This allows the state in which chassis 40 and planar conductor 20 are spaced apart to be maintained. In the embodiment, the distance between chassis 40 and planar conductor 20 is approximately 10 mm.

Chassis 40 is a member that is disposed spaced apart from planar conductor 20 and formed of a conductive material. In the embodiment, chassis 40 is a rectangular parallelepiped metal member extending along planar conductor 20. The length of chassis 40 in the second direction may be approximately the same as that of planar conductor 20. In the embodiment, the lengths of chassis 40 in the first direction and the second direction are 135 mm and 25 mm, respectively, and the length in the direction perpendicular to the first direction and the second direction is 58 mm.

Chassis 40 is formed of, for example, magnesium, and functions as the ground of multiband compatible antenna 10. Chassis 40 may constitute, for example, a frame body of a radio communication device that uses multiband compatible antenna 10.

[1-2. Frequency Characteristics]

The frequency characteristics of multiband compatible antenna 10 according to the embodiment will be described with reference to drawings.

Figure 2:
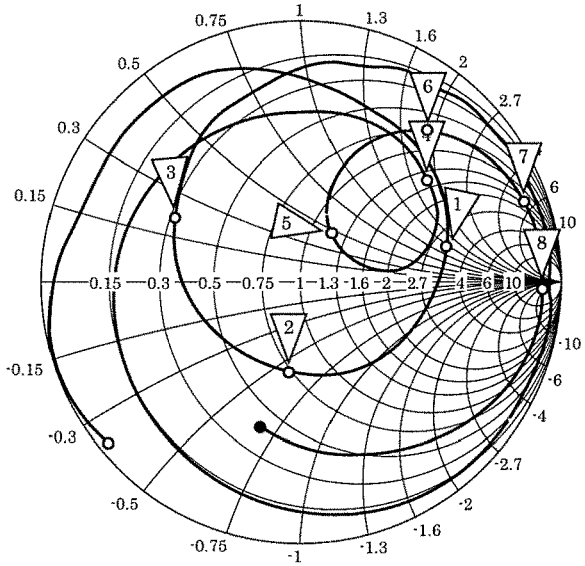
FIG. 2 is a Smith chart illustrating the frequency characteristics of the impedance of the multiband compatible antenna according to Embodiment 1.
Figure 3:
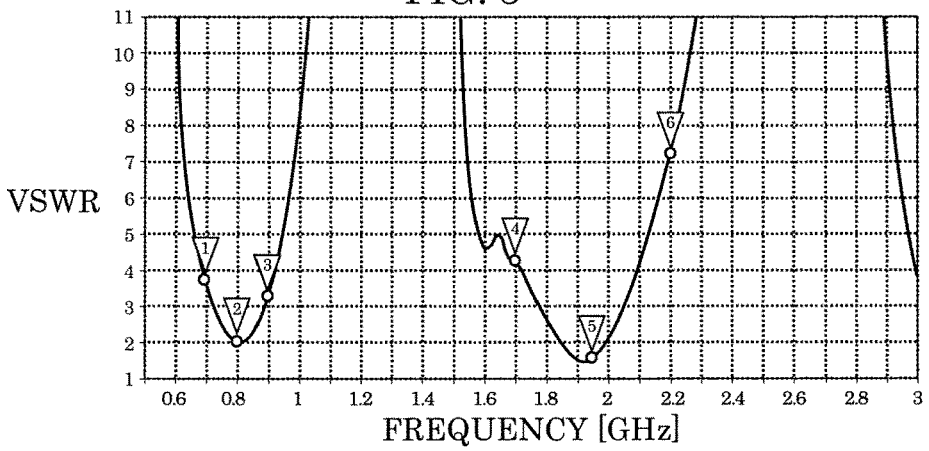
FIG. 3 is a graph illustrating the frequency characteristics of the voltage standing wave ratio of the multiband compatible antenna according to Embodiment 1.

FIG. 2 is a Smith chart illustrating the frequency characteristics of the impedance of multiband compatible antenna 10 according to the embodiment. FIG. 3 is a graph illustrating the frequency characteristics of the voltage standing wave ratio of multiband compatible antenna 10 according to the embodiment.

As illustrated in FIG. 2 and FIG. 3, multiband compatible antenna 10 can resonate at the first frequency and the second frequency. Furthermore, multiband compatible antenna 10 can obtain a wide resonance frequency band in both a frequency band including the first frequency and a frequency band including the second frequency. That is, multiband compatible antenna 10 can obtain high radiation efficiency in a wide frequency band.

[1-3. Summary]

As described above, multiband compatible antenna 10 according to the embodiment resonates at the first frequency and the second frequency higher than the first frequency. Multiband compatible antenna 10 includes planar conductor 20 that includes feeding portion 26 to which a signal is supplied and grounding portion 27 which is grounded, and has slit 50 formed between feeding portion 26 and grounding portion 27. Slit 50 includes first slit portion 51 extending in the first direction and second slit portion 52 extending in the second direction intersecting with the first direction from the end of first slit portion 51, and first slit portion 51 is disposed at a position closer to one edge 24 than the center of planar conductor 20 in the second direction. Feeding portion 26 is disposed at the one edge 24-side relative to first slit portion 51, and planar conductor 20 includes first element portion 21 that resonates at the first frequency and second element portion 22 that resonates at the second frequency, and second slit portion 52 is disposed in first element portion 21.

Thereby, a wide resonance frequency band can be obtained in each frequency band including the first frequency and the second frequency. That is, high radiation efficiency can be obtained in the wide frequency band. On top of that, in the embodiment, multiband compatible antenna 10 includes planar conductor 20, and slit 50 formed on planar conductor 20 includes first slit portion 51 and second slit portion 52, and thereby multiband compatible antenna 10 can be miniaturized.

In multiband compatible antenna 10, the electrical length of slit 50 in first element portion 21 may be at least 0.15 times and at most 0.35 times the effective wavelength corresponding to the first frequency, and the electrical length of slit 50 in second element portion 22 may be at least 0.15 times and at most 0.35 times the effective wavelength corresponding to the second frequency.

In this case, because the electrical length of the path from feeding portion 26 to grounding portion 27 in first element portion 21 is approximately a half of the effective wavelength corresponding to the first frequency, resonance at the first frequency is obtained in first element portion 21. In the same manner, because the electrical length of the path from feeding portion 26 to grounding portion 27 in second element portion 22 is approximately a half of the effective wavelength corresponding to the second frequency, resonance at the second frequency is obtained in second element portion 22.

In multiband compatible antenna 10, the electrical length of slit 50 in first element portion 21 may be at least 0.4 times and at most 0.6 times the effective wavelength corresponding to the second frequency.

Thereby, resonance not only at the first frequency but also at the second frequency is obtained in first element portion 21. For this reason, the resonance frequency band including the second frequency can be widened.

Embodiment 2

A multiband compatible antenna according to Embodiment 2 will be described. The multiband compatible antenna according to the embodiment is different from multiband compatible antenna 10 according to Embodiment 1 in that the planar conductor is branched. Hereinafter, the multiband compatible antenna according to the embodiment will be described focusing on the difference from multiband compatible antenna 10 according to Embodiment 1.

[2-1. Overall Configuration]

The overall configuration of the multiband compatible antenna according to the embodiment will be described with reference to drawings.

Figure 4:
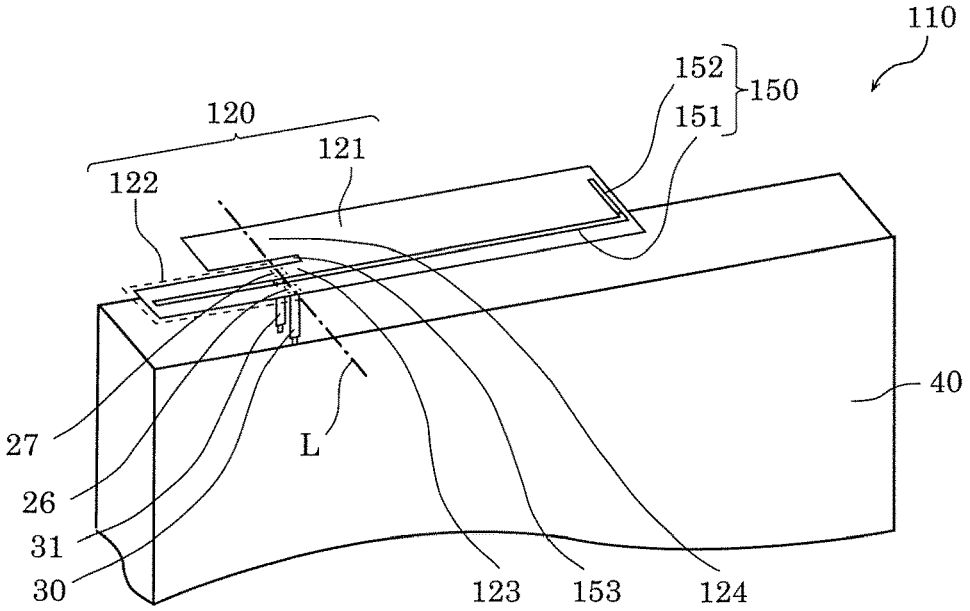
FIG. 4 is a perspective view illustrating an appearance of a multiband compatible antenna according to Embodiment 2.

FIG. 4 is a perspective view illustrating an appearance of multiband compatible antenna 110 according to the embodiment.

Multiband compatible antenna 110 according to the embodiment resonates at the first frequency and the second frequency higher than the first frequency in the same manner as multiband compatible antenna 10 according to Embodiment 1. As illustrated in FIG. 4, multiband compatible antenna 110 includes planar conductor 120, feeding element 30, short circuit element 31, and chassis 40.

Planar conductor 120 is a planar conductor that includes feeding portion 26 to which a signal is supplied and grounding portion 27 which is grounded, and has slit 150 formed between feeding portion 26 and grounding portion 27.

Slit 150 includes first slit portion 151 extending in a first direction and second slit portion 152 extending in a second direction intersecting with the first direction from an end of first slit portion 151. First slit portion 151 is disposed at a position closer to one edge than the center of planar conductor 120 in the second direction, and feeding portion 26 is disposed at the one edge-side relative to first slit portion 151. Planar conductor 120 includes first element portion 121 extending toward one side from straight line L passing through feeding portion 26 and grounding portion 27 and second element portion 122 extending toward the other side from the straight line, and second slit portion 152 is disposed in first element portion 121.

In the embodiment, first element portion 121 of planar conductor 120 is branched at the grounding portion 27-side relative to slit 150 into non-open portion 123 where grounding portion 27 is disposed and open portion 124 forming an open end with branching slit 153. A part in open portion 124 on the second element portion 122-side from straight line L is included in first element portion 121. That is, second element portion 122 in the embodiment is a part surrounded by a dashed frame in FIG. 4, and first element portion 121 is a part other than second element portion 122 of planar conductor 120.

In the embodiment, the lengths of first element portion 121 and second element portion 122 in the first direction are 67 mm and 27 mm, respectively, and the length of first element portion 121 in the second direction is 25 mm.

The length of open portion 124 in the first direction, that is, the length of branching slit 153 is not specifically limited, but is 17 mm in the embodiment. In addition, the lengths of non-open portion 123 and open portion 124 in the second direction are approximately 10 mm and 15 mm, respectively.

As described above, in the embodiment, first element portion 121 is branched at the grounding portion 27-side relative to slit 150 into non-open portion 123 where grounding portion 27 is disposed and open portion 124 forming an open end. This allows multiband compatible antenna 110 to obtain resonance at a third frequency other than the first frequency and the second frequency. The third frequency will be described in detail later.

[2-2. Frequency Characteristics]

The frequency characteristics of multiband compatible antenna 110 according to the embodiment will be described with reference to drawings.

Figure 5:
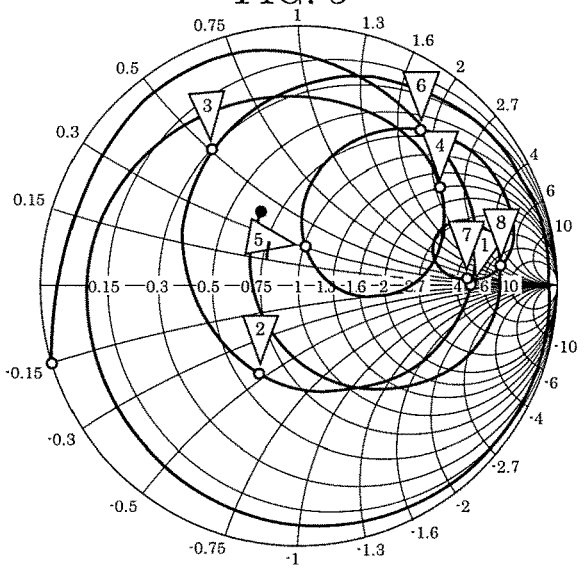
FIG. 5 is a Smith chart illustrating the frequency characteristics of the impedance of the multiband compatible antenna according to Embodiment 2.
Figure 6:
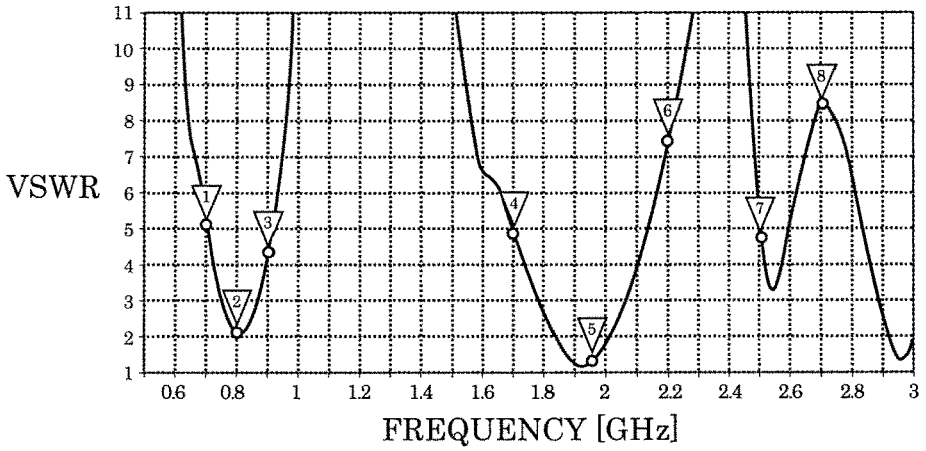
FIG. 6 is a graph illustrating the frequency characteristics of the voltage standing wave ratio of the multiband compatible antenna according to Embodiment 2.

FIG. 5 is a Smith chart illustrating the frequency characteristics of the impedance of multiband compatible antenna 110 according to the embodiment. FIG. 6 is a graph illustrating the frequency characteristics of the voltage standing wave ratio of multiband compatible antenna 110 according to the embodiment.

As illustrated in FIG. 5 and FIG. 6, multiband compatible antenna 110 can resonate at the first frequency and the second frequency. Furthermore, multiband compatible antenna 110 can obtain a wide resonance frequency band in each frequency band including the first frequency and the second frequency. That is, multiband compatible antenna 110 can obtain high radiation efficiency in the wide frequency band. In addition, as illustrated in FIG. 6, in the embodiment, resonance can be obtained at the third frequency different from the first frequency and the second frequency. In the embodiment, the third frequency is approximately 2.5 GHz or approximately 3 GHz. As described above, multiband compatible antenna 110 is also usable at a resonance frequency band including the third frequency.

The frequency characteristics of multiband compatible antenna 110 in the vicinity of the third frequency can be adjusted by changing the dimensions of non-open portion 123 and open portion 124. Hereinafter, frequency characteristics when the dimensions of non-open portion 123 and open portion 124 are changed will be described with reference to drawings.

Figure 7:
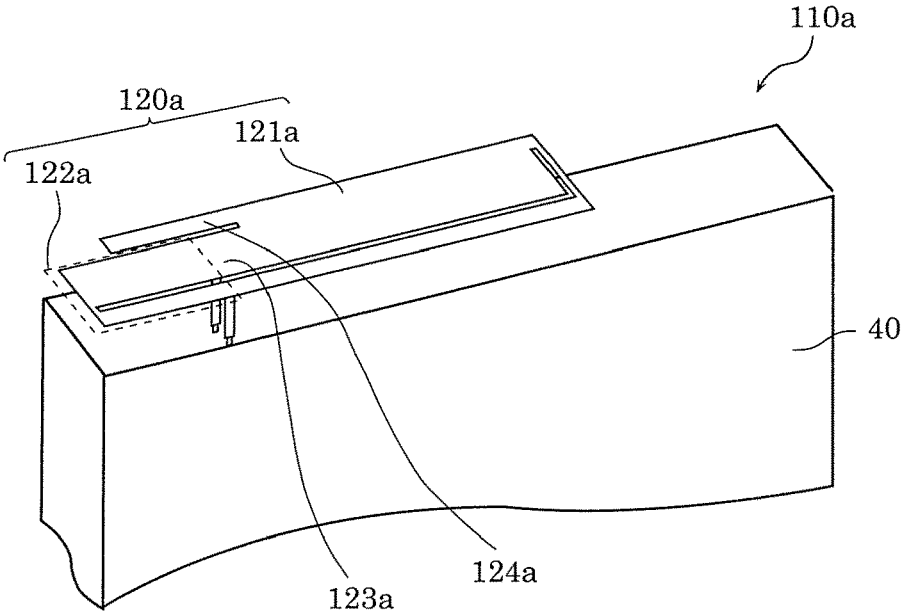
FIG. 7 is a perspective view illustrating an appearance of a multiband compatible antenna according to a variation of Embodiment 2.

FIG. 7 is a perspective view illustrating an appearance of multiband compatible antenna 110*a* according to a variation of the embodiment. As illustrated in FIG. 7, multiband compatible antenna 110*a* according to the variation includes planar conductor 120*a*. Planar conductor 120*a* includes first element portion 121*a* and second element portion 122*a*, and first element portion 121*a* is branched into non-open portion 123*a* and open portion 124*a*. In the variation, the widths of non-open portion 123*a* and open portion 124*a* (lengths in the second direction) are different from the widths of non-open portion 123 and open portion 124 of multiband compatible antenna 110. Specifically, the width of non-open portion 123*a* according to the variation is approximately 20 mm, and the width of open portion 124*a* is approximately 5 mm. The frequency characteristics of multiband compatible antenna 110*a* having such a shape will be described with reference to drawings.

Figure 8:
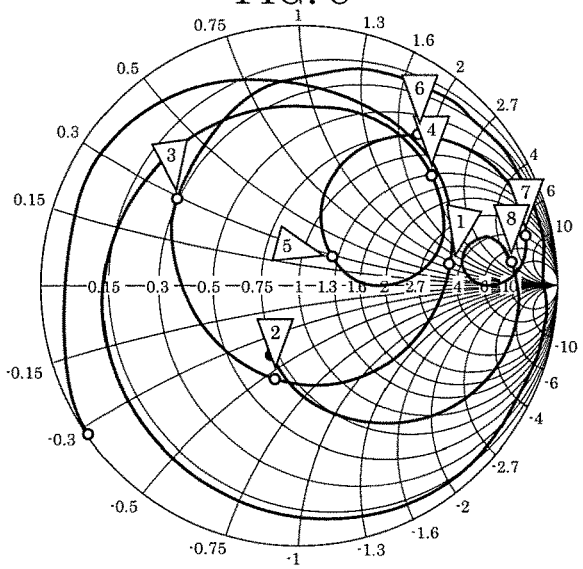
FIG. 8 is a Smith chart illustrating the frequency characteristics of the impedance of the multiband compatible antenna according to the variation of Embodiment 2.
Figure 9:
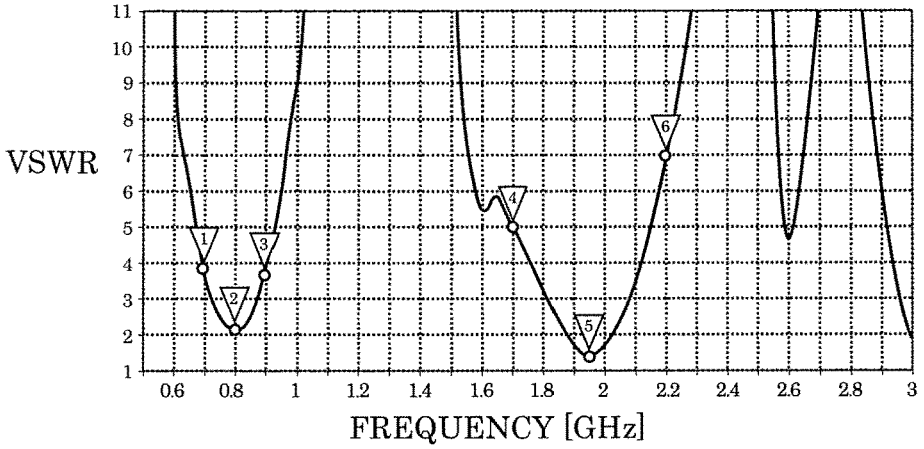
FIG. 9 is a graph illustrating the frequency characteristics of the voltage standing wave ratio of the multiband compatible antenna according to the variation of Embodiment 2.

FIG. 8 is a Smith chart illustrating the frequency characteristics of the impedance of multiband compatible antenna 110*a* according to the variation. FIG. 9 is a graph illustrating the frequency characteristics of the voltage standing wave ratio of multiband compatible antenna 110*a* according to the variation.

As illustrated in FIG. 8 and FIG. 9, multiband compatible antenna 110*a* can also resonate at each frequency band including the first frequency and the second frequency in the same manner as multiband compatible antenna 110. In addition, as illustrated in FIG. 9, also in the variation, resonance can be obtained at the frequency bands of approximately 2.5 GHz and approximately 3 GHz. However, in multiband compatible antenna 110*a* according to the variation, the widths of a resonance frequency band including a frequency of approximately 2.5 GHz and a resonance frequency band including a frequency of approximately 3 GHz are narrower than that of multiband compatible antenna 110.

As described above, in the embodiment, the frequency characteristics of the multiband compatible antenna can be adjusted by changing the shapes of the non-open portion and the open portion.

[2-3. Summary]

As described above, in multiband compatible antenna 110 according to the embodiment, first element portion 121 is branched at the grounding portion 27-side relative to slit 150 into non-open portion 123 where grounding portion 27 is disposed and open portion 124 forming an open end.

Thereby, multiband compatible antenna 110 can resonate at the third frequency different from the first frequency and the second frequency.

The characteristics of multiband compatible antenna 110 in a frequency band including the third frequency can be adjusted by changing the shapes of non-open portion 123 and open portion 124.

Embodiment 3

A multiband compatible antenna according to Embodiment 3 will be described. The multiband compatible antenna according to the embodiment is different from multiband compatible antenna 110 according to Embodiment 2 in that a ground wire that extends toward the open portion and is grounded is included. Hereinafter, the multiband compatible antenna according to the embodiment will be described focusing on the difference from multiband compatible antenna 110 according to Embodiment 2.

[3-1. Overall Configuration]

The overall configuration of the multiband compatible antenna according to the embodiment will be described with reference to drawings.

Figure 10:
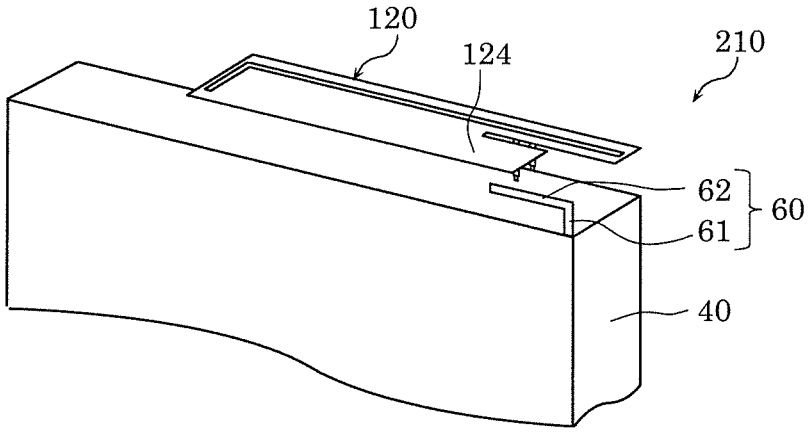
FIG. 10 is a perspective view illustrating an appearance of a multiband compatible antenna according to Embodiment 3.
Figure 11:
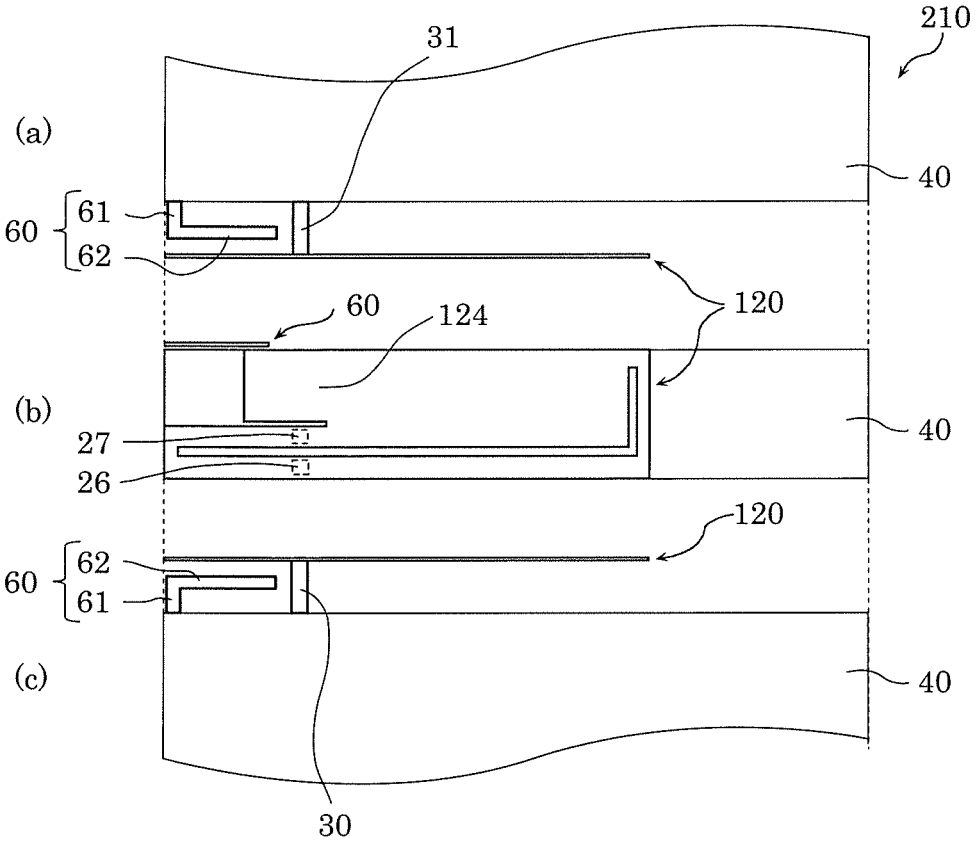
FIG. 11 is a diagram illustrating the shape of the multiband compatible antenna according to Embodiment 3.

FIG. 10 is a perspective view illustrating an appearance of multiband compatible antenna 210 according to the embodiment. FIG. 11 is a diagram illustrating the shape of multiband compatible antenna 210 according to the embodiment. FIG. 11 illustrates one side view (a), top view (b), and other side view (c) of multiband compatible antenna 210.

Multiband compatible antenna 210 according to the embodiment illustrated in FIG. 10 and FIG. 11 resonates at the first frequency and the second frequency higher than the first frequency in the same manner as multiband compatible antenna 110 according to Embodiment 2. As illustrated in FIG. 10 and FIG. 11, multiband compatible antenna 210 includes planar conductor 120, feeding element 30, short circuit element 31, and chassis 40 in the same manner as multiband compatible antenna 110 according to Embodiment 2. Multiband compatible antenna 210 according to the embodiment further includes ground wire 60.

Ground wire 60 is a member that is formed of a conductive material which is short-circuited to chassis 40 and that is disposed spaced apart from planar conductor 120. One end of ground wire 60 is disposed at a position that is spaced apart from chassis 40 and closer to open portion 124 than feeding portion 26. In the embodiment, ground wire 60 extends toward open portion 124 of planar conductor 120. Ground wire 60 is electrically connected to chassis 40 and influences the coupling characteristics between planar conductor 120 and chassis 40. In the embodiment, ground wire 60 includes first ground wire portion 61 that is connected to chassis 40 and extends in a direction perpendicular to a main surface of planar conductor 120 and second ground wire portion 62 that extends in a first direction toward open portion 124 from an end of first ground wire portion 61. First ground wire portion 61 and second ground wire portion 62 are both long planar conductive members and have lengths of 5 mm and 20 mm, respectively. Note that the shape and arrangement of ground wire 60 are not limited to the examples illustrated in FIG. 10 and FIG. 11. It is sufficient that ground wire 60 be disposed spaced apart from planar conductor 120, and its tip be disposed away from chassis 40, at a position closer to open portion 124 than feeding element 30, and may extend, for example, in a direction other than the first direction. Ground wire 60 is formed of a conductive material, for example, aluminum or copper.

[3-2. Frequency Characteristics]

The frequency characteristics of multiband compatible antenna 210 according to the embodiment will be described with reference to drawings.

Figure 12:
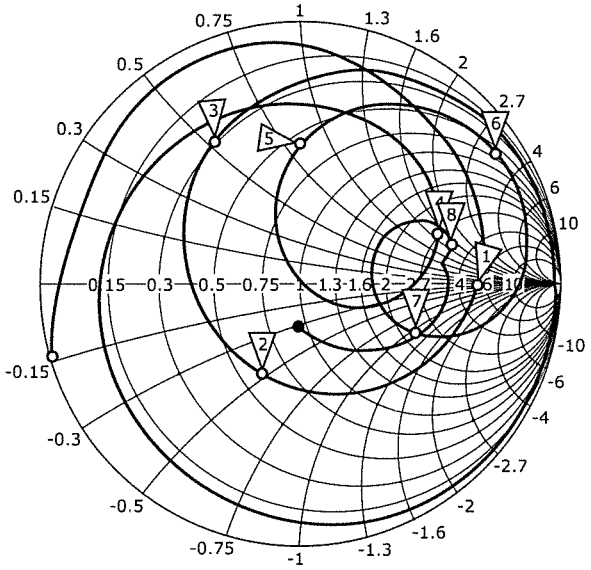
FIG. 12 is a Smith chart illustrating the frequency characteristics of the impedance of the multiband compatible antenna according to Embodiment 3.
Figure 13:
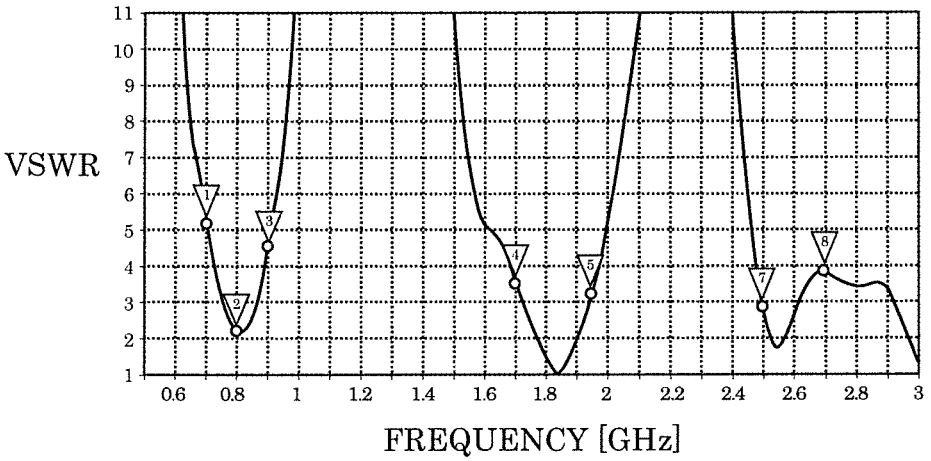
FIG. 13 is a graph illustrating the frequency characteristics of the voltage standing wave ratio of the multiband compatible antenna according to Embodiment 3.

FIG. 12 is a Smith chart illustrating the frequency characteristics of the impedance of multiband compatible antenna 210 according to the embodiment. FIG. 13 is a graph illustrating the frequency characteristics of the voltage standing wave ratio of multiband compatible antenna 210 according to the embodiment.

As illustrated in FIG. 12 and FIG. 13, multiband compatible antenna 210 can resonate at the first frequency and the second frequency. In addition, as illustrated in FIG. 13, in the embodiment, resonance at a third frequency different from the first frequency and the second frequency can be obtained. In the embodiment, the third frequency is approximately 2.5 GHz or approximately 3 GHz. Furthermore, in the embodiment, by including ground wire 60, a resonance frequency band including the third frequency is widened as compared to multiband compatible antenna 110 according to Embodiment 2. That is, multiband compatible antenna 210 can obtain high radiation efficiency in the wide frequency band including the third frequency.

Here, in order to explain the effect of ground wire 60, a multiband compatible antenna according to a variation of the embodiment will be described with reference to drawings.

Figure 14:
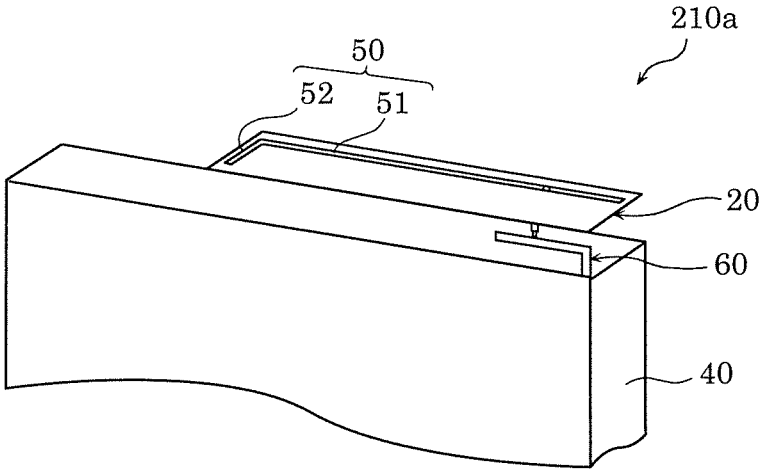
FIG. 14 is a perspective view illustrating an appearance of a multiband compatible antenna according to a variation of Embodiment 3.

FIG. 14 is a perspective view illustrating an appearance of multiband compatible antenna 210*a* according to the variation of the embodiment. As illustrated in FIG. 14, multiband compatible antenna 210*a* according to the variation is different from multiband compatible antenna 210 according to Embodiment 3 in that multiband compatible antenna 210*a* does not have the branch structure of non-open portion 123 and open portion 124, and accords in other points. More specifically, multiband compatible antenna 210*a* has substantially rectangular planar conductor 20. Planar conductor 20 has the same configuration as planar conductor 20 according to Embodiment 1, and slit 50 composed of first slit portion 51 and second slit portion 52 is formed. The frequency characteristics of multiband compatible antenna 210*a* having such a shape will be described with reference to drawings.

Figure 15:
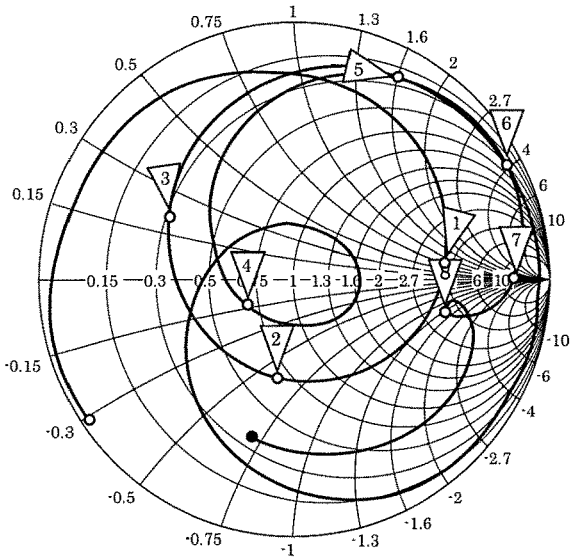
FIG. 15 is a Smith chart illustrating the frequency characteristics of the impedance of the multiband compatible antenna according to the variation of Embodiment 3.
Figure 16:
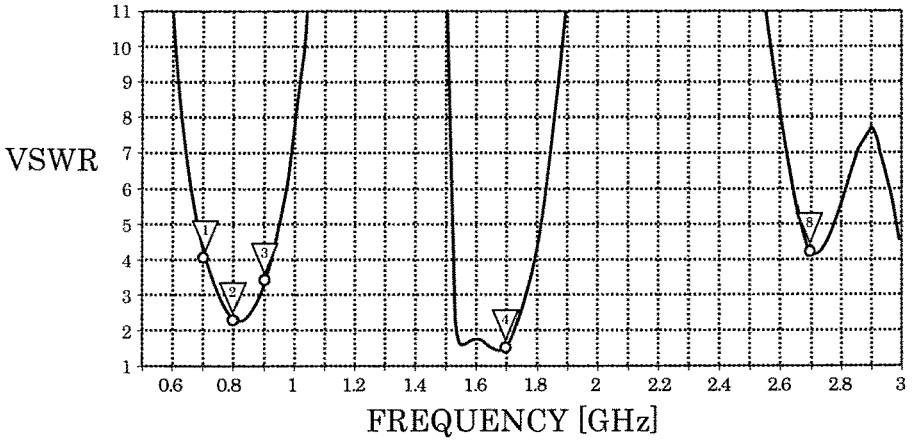
FIG. 16 is a graph illustrating the frequency characteristics of the voltage standing wave ratio of the multiband compatible antenna according to the variation of Embodiment 3.

FIG. 15 is a Smith chart illustrating the frequency characteristics of the impedance of multiband compatible antenna 210*a* according to the variation. FIG. 16 is a graph illustrating the frequency characteristics of the voltage standing wave ratio of multiband compatible antenna 210*a* according to the variation.

As illustrated in FIG. 15 and FIG. 16, in multiband compatible antenna 210*a* according to the variation, the band width of a resonance frequency band including the third frequency is narrower than that of multiband compatible antenna 210 according to Embodiment 3 illustrated in FIG. 13. That is, the effect of ground wire 60 becomes more prominent when planar conductor 120 includes open portion 124.

[3-3. Summary]

As described above, multiband compatible antenna 210 according to the embodiment includes chassis 40 that is disposed spaced apart from planar conductor 20 and formed of a conductive material which is short-circuited to grounding portion 27 and ground wire 60 that is formed of a conductive material which is short-circuited to chassis 40 and that is disposed spaced apart from planar conductor 120. One end of ground wire 60 is disposed at a position that is spaced apart from chassis 40 and closer to open portion 124 than feeding portion 26.

Thereby, a resonance frequency band including the third frequency is widened. That is, multiband compatible antenna 210 can obtain high radiation efficiency also in the wide frequency band including the third frequency.

Embodiment 4

A multiband compatible antenna according to Embodiment 4 will be described. The multiband compatible antenna according to the embodiment is different from multiband compatible antenna 10 according to Embodiment 1 in the shape of the feeding element. Hereinafter, the multiband compatible antenna according to the embodiment will be described focusing on the difference from multiband compatible antenna 10 according to Embodiment 1.

[4-1. Overall Configuration]

The overall configuration of the multiband compatible antenna according to the embodiment will be described with reference to drawings.

Figure 17:
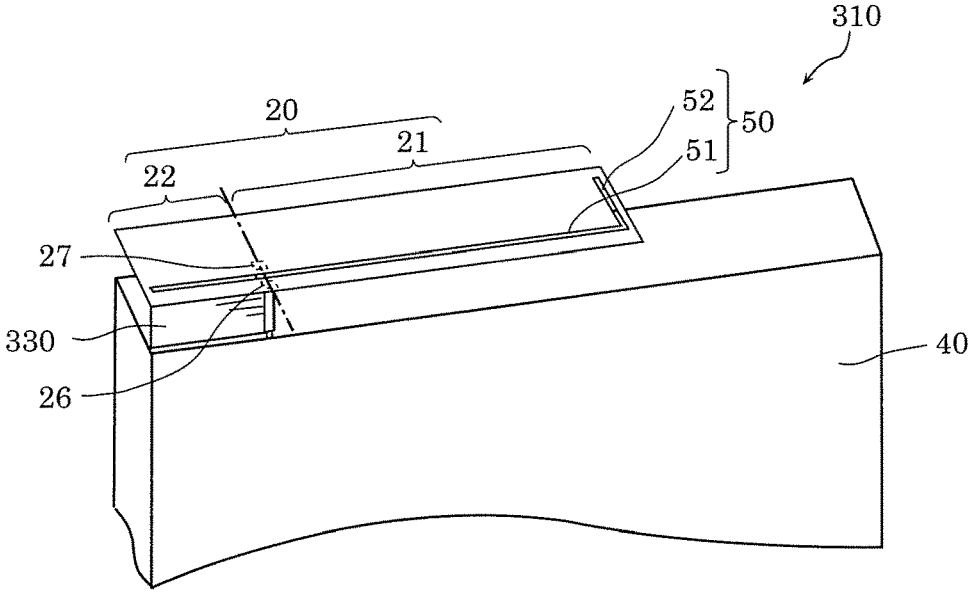
FIG. 17 is a perspective view illustrating an appearance of a multiband compatible antenna according to Embodiment 4.

FIG. 17 is a perspective view illustrating an appearance of multiband compatible antenna 310 according to the embodiment.

As illustrated in FIG. 17, multiband compatible antenna 310 according to the embodiment resonates at the first frequency and the second frequency higher than the first frequency in the same manner as multiband compatible antenna 10 according to Embodiment 1. As illustrated in FIG. 17, multiband compatible antenna 310 includes planar conductor 20, feeding element 330, short circuit element 31 (not illustrated in FIG. 17), and chassis 40 in the same manner as multiband compatible antenna 10 according to Embodiment 1. In multiband compatible antenna 310 according to the embodiment, feeding element 330 has a planar shape extending from feeding portion 26 of planar conductor 20 toward the second element portion 22-side along slit 50. This allows the impedance of second element portion 22 to be lowered. Since the impedance at the second frequency is often high, by reducing the impedance, matching can be achieved and a resonance frequency band can be widened.

[4-2. Frequency Characteristics]

The frequency characteristics of multiband compatible antenna 310 according to the embodiment will be described with reference to drawings.

Figure 18:
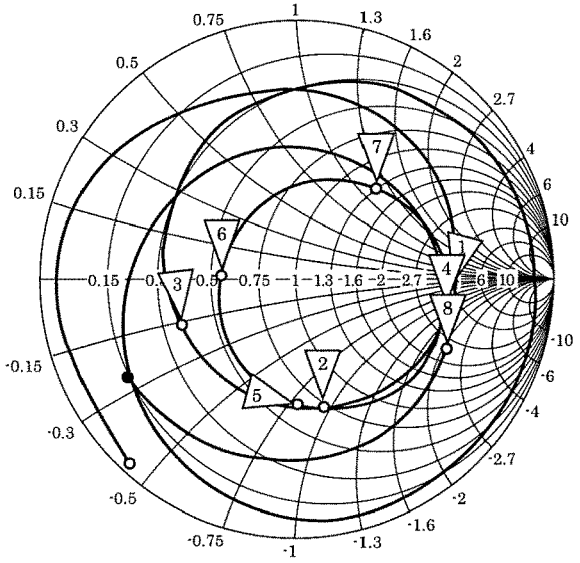
FIG. 18 is a Smith chart illustrating the frequency characteristics of the impedance of the multiband compatible antenna according to Embodiment 4.
Figure 19:
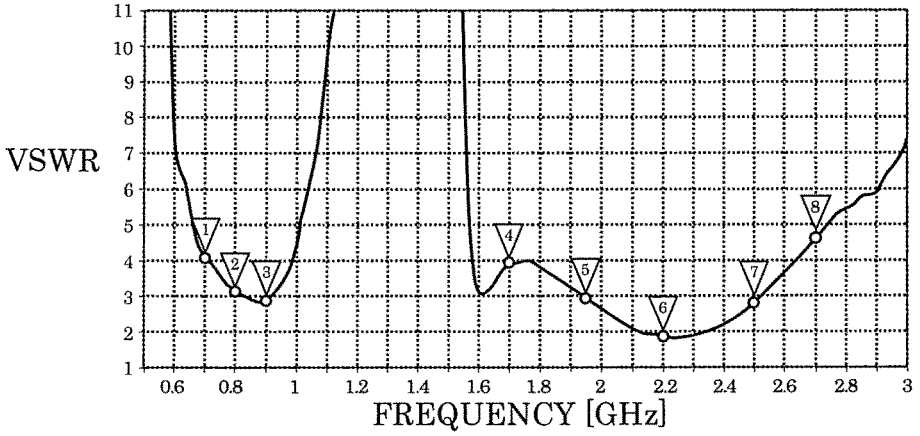
FIG. 19 is a graph illustrating the frequency characteristics of the voltage standing wave ratio of the multiband compatible antenna according to Embodiment 4.

FIG. 18 is a Smith chart illustrating the frequency characteristics of the impedance of multiband compatible antenna 310 according to the embodiment. FIG. 19 is a graph illustrating the frequency characteristics of the voltage standing wave ratio of multiband compatible antenna 310 according to the embodiment.

As illustrated in FIG. 18 and FIG. 19, multiband compatible antenna 310 can resonate at the first frequency and the second frequency. Furthermore, multiband compatible antenna 310 can widen a resonance frequency band including the second frequency as compared to multiband compatible antenna 10 according to Embodiment 1. In the example illustrated in FIG. 19, a wide resonance frequency band including from approximately 1.7 GHz to approximately 2.7 GHz can be obtained. That is, multiband compatible antenna 310 can obtain high radiation efficiency in a wider frequency band.

[4-3. Summary]

As described above, multiband compatible antenna 310 according to the embodiment includes feeding element 330 that is disposed at feeding portion 26, and supplies a signal to planar conductor 20, and the feeding element has a planar shape extending from feeding portion 26 toward the second element portion 22-side along slit 50.

Since this increases the degree of freedom in selecting a current path from feeding element 330 to second element portion 22, the resonance frequency band including the second frequency can be further widened.

Embodiment 5

A multiband compatible antenna according to Embodiment 5 will be described. The multiband compatible antenna according to the embodiment is different from multiband compatible antenna 10 according to Embodiment 1 in the shape of the slit in the second element portion of the planar conductor. Hereinafter, the multiband compatible antenna according to the embodiment will be described focusing on the difference from multiband compatible antenna 10 according to Embodiment 1.

[5-1. Overall Configuration]

The overall configuration of the multiband compatible antenna according to the embodiment will be described with reference to drawings.

Figure 20:
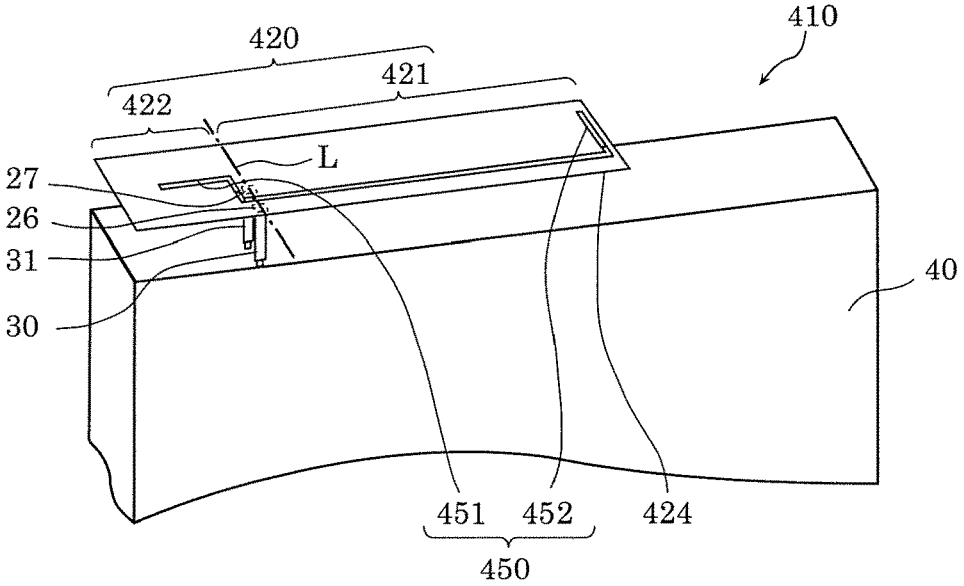
FIG. 20 is a perspective view illustrating an appearance of a multiband compatible antenna according to Embodiment 5.

FIG. 20 is a perspective view illustrating an appearance of multiband compatible antenna 410 according to the embodiment.

As illustrated in FIG. 20, multiband compatible antenna 410 according to the embodiment resonates at the first frequency and the second frequency higher than the first frequency in the same manner as multiband compatible antenna 10 according to Embodiment 1. As illustrated in FIG. 20, multiband compatible antenna 410 includes planar conductor 420, feeding element 30, short circuit element 31, and chassis 40 in the same manner as multiband compatible antenna 10 according to Embodiment 1.

Planar conductor 420 has slit 450 formed. Slit 450 includes first slit portion 451 extending in a first direction and second slit portion 452 extending in a second direction intersecting with the first direction from an end of first slit portion 451. Planar conductor 20 includes first element portion 421 extending toward one side from straight line L passing through feeding portion 26 and grounding portion 27 and second element portion 422 extending toward the other side from the straight line, and second slit portion 452 is disposed in first element portion 421. First slit portion 451 is disposed, in first element portion 421, at a position closer to one edge 424 than the center of planar conductor 420 in the second direction, and is disposed, in second element portion 422, at a position closer to the center in the second direction than first slit portion 451 in first element portion 421. In the example illustrated in FIG. 20, first slit portion 451 in second element portion 422 is disposed at the center of planar conductor 420 in the second direction. This increases the degree of freedom in selecting a current path from feeding element 30 to second element portion 422.

[5-2. Frequency Characteristics]

The frequency characteristics of multiband compatible antenna 410 according to the embodiment will be described with reference to drawings.

Figure 21:
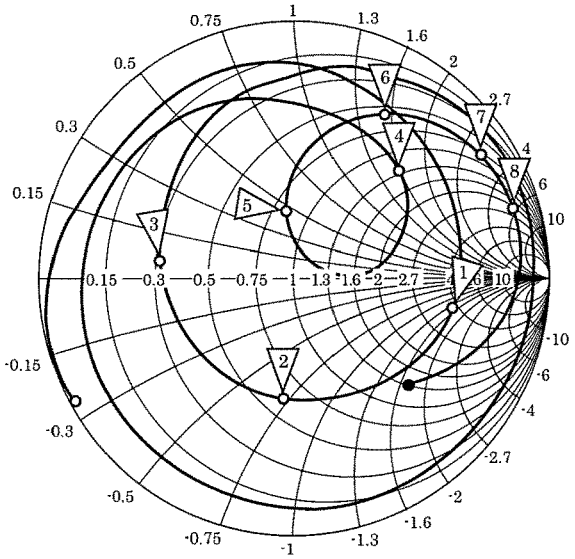
FIG. 21 is a Smith chart illustrating the frequency characteristics of the impedance of the multiband compatible antenna according to Embodiment 5.
Figure 22:
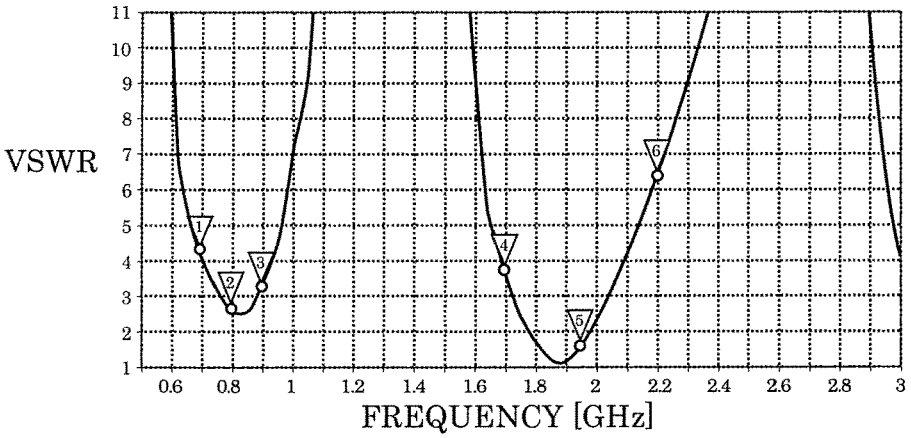
FIG. 22 is a graph illustrating the frequency characteristics of the voltage standing wave ratio of the multiband compatible antenna according to Embodiment 5.

FIG. 21 is a Smith chart illustrating the frequency characteristics of the impedance of multiband compatible antenna 410 according to the embodiment. FIG. 22 is a graph illustrating the frequency characteristics of the voltage standing wave ratio of multiband compatible antenna 410 according to the embodiment.

As illustrated in FIG. 21 and FIG. 22, multiband compatible antenna 410 can resonate at the first frequency and the second frequency. Furthermore, multiband compatible antenna 410 can widen a resonance frequency band including the second frequency as compared to multiband compatible antenna 10 according to Embodiment 1. That is, multiband compatible antenna 410 can obtain high radiation efficiency in a wider frequency band.

[5-3. Summary]

As described above, in multiband compatible antenna 410 according to the embodiment, first slit portion 451 in second element portion 422 is disposed closer to the center in the second direction than first slit portion 451 in first element portion 421.

Since this increases the degree of freedom in selecting a current path from feeding element 330 to second element portion 422, the resonance frequency band including the second frequency can be further widened.

Embodiment 6

A multiband compatible antenna according to Embodiment 6 will be described. The multiband compatible antenna according to the embodiment is different from multiband compatible antenna 210 according to Embodiment 3 in the shape of the feeding element. Hereinafter, the multiband compatible antenna according to the embodiment will be described focusing on the difference from multiband compatible antenna 210 according to Embodiment 3.

[6-1. Overall Configuration]

The overall configuration of the multiband compatible antenna according to the embodiment will be described with reference to drawings.

Figure 23:
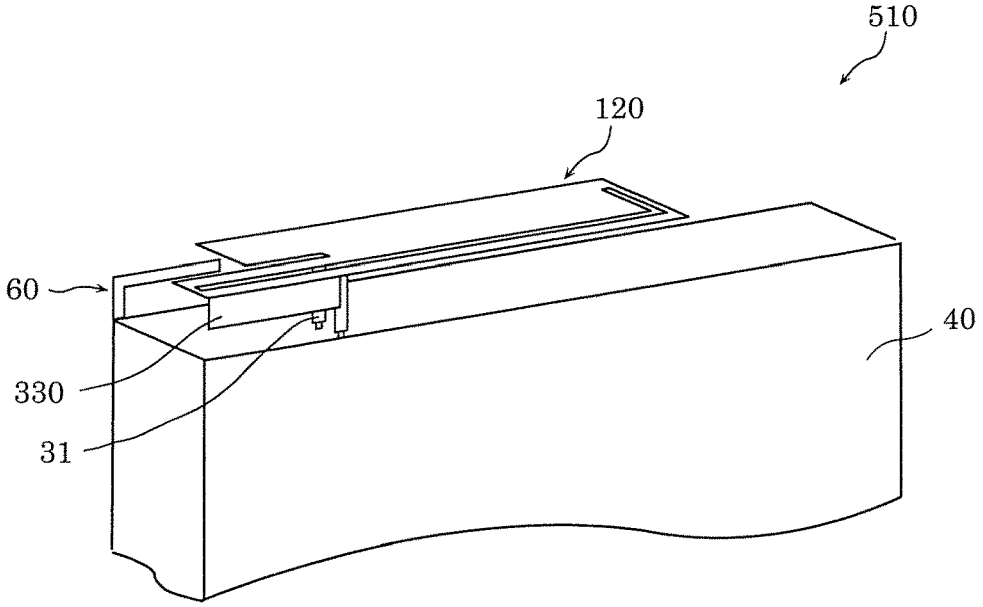
FIG. 23 is a perspective view illustrating an appearance of a multiband compatible antenna according to Embodiment 6.

FIG. 23 is a perspective view illustrating an appearance of multiband compatible antenna 510 according to the embodiment.

Multiband compatible antenna 510 according to the embodiment resonates at the first frequency and the second frequency higher than the first frequency in the same manner as multiband compatible antenna 210 according to Embodiment 3. As illustrated in FIG. 23, multiband compatible antenna 510 includes planar conductor 120, feeding element 330, short circuit element 31, chassis 40, and ground wire 60. Planar conductor 120 has the same configuration as planar conductor 120 according to Embodiment 3. In addition, feeding element 330 has the same configuration as feeding element 330 according to Embodiment 4. Thereby, a multiband compatible antenna having the features of both multiband compatible antennas according to Embodiment 3 and Embodiment 4 can be embodied.

[6-2. Frequency Characteristics]

The frequency characteristics of multiband compatible antenna 510 according to the embodiment will be described with reference to drawings.

Figure 24:
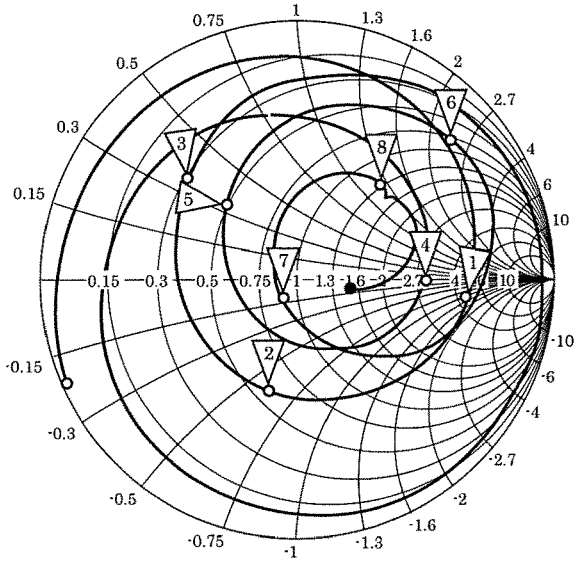
FIG. 24 is a Smith chart illustrating the frequency characteristics of the impedance of the multiband compatible antenna according to Embodiment 6.
Figure 25:
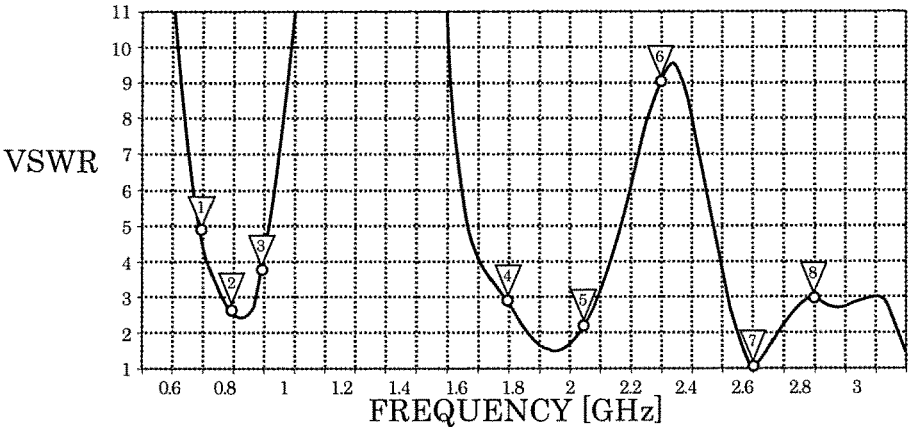
FIG. 25 is a graph illustrating the frequency characteristics of the voltage standing wave ratio of the multiband compatible antenna according to Embodiment 6.

FIG. 24 is a Smith chart illustrating the frequency characteristics of the impedance of multiband compatible antenna 510 according to the embodiment. FIG. 25 is a graph illustrating the frequency characteristics of the voltage standing wave ratio of multiband compatible antenna 510 according to the embodiment.

As illustrated in FIG. 24 and FIG. 25, multiband compatible antenna 510 can resonate at the first frequency and the second frequency. Furthermore, multiband compatible antenna 510 can widen a resonance frequency band including the second frequency as compared to multiband compatible antenna 210 according to Embodiment 3. That is, multiband compatible antenna 510 can obtain high radiation efficiency in a wider frequency band.

Embodiment 7

A multiband compatible antenna according to Embodiment 7 will be described. The multiband compatible antenna according to the embodiment is different from multiband compatible antenna 10 according to Embodiment 1 in mainly the shape of the planar conductor. Hereinafter, the multiband compatible antenna according to the embodiment will be described focusing on the difference from multiband compatible antenna 10 according to Embodiment 1.

[7-1. Overall Configuration]

The overall configuration of the multiband compatible antenna according to the embodiment will be described with reference to drawings.

Figure 26:
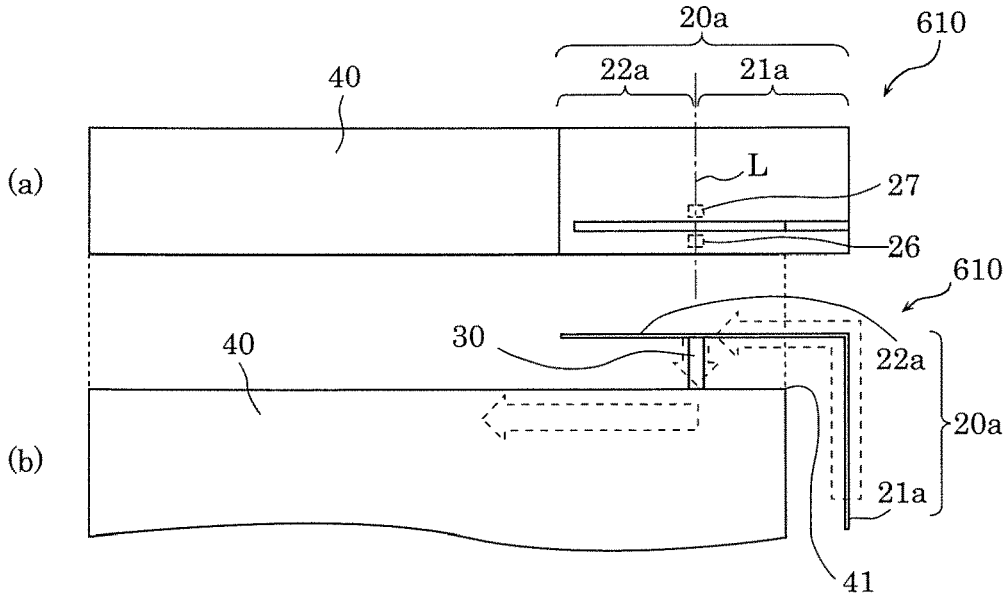
FIG. 26 is a diagram illustrating the shape of a multiband compatible antenna according to Embodiment 7.

FIG. 26 is a diagram illustrating the shape of multiband compatible antenna 610 according to the embodiment. FIG. 26 illustrates top view (a) and side view (b) of multiband compatible antenna 610. In side view (b) of FIG. 26, an example of the path of current flowing through multiband compatible antenna 610 is indicated by dashed arrows.

Multiband compatible antenna 610 according to the embodiment resonates at the first frequency and the second frequency higher than the first frequency in the same manner as multiband compatible antenna 10 according to Embodiment 1. As illustrated in FIG. 26, multiband compatible antenna 610 includes planar conductor 20*a*, feeding element 30, chassis 40, and ground wire 60. Planar conductor 20*a* includes first element portion 21*a* and second element portion 22*a*. Note that multiband compatible antenna 610 includes short circuit element 31 that short-circuits grounding portion 27 of planar conductor 20*a* and chassis 40 in the same manner as multiband compatible antenna 10 according to Embodiment 1 although it is not illustrated in FIG. 26. As illustrated in side view (b) of FIG. 26, planar conductor 20*a* is different from planar conductor 20 according to Embodiment 1 in having a bent shape when viewed from a second direction. Chassis 40 has corner portion 41 and planar conductor 20*a* has a shape bent along corner portion 41. At least part of first element portion 21*a* of planar conductor

20*a* extends in a direction intersecting with the longitudinal direction of chassis 40. In the embodiment, the longitudinal direction of chassis 40 is the horizontal direction in FIG. 26.

[7-2. Effects]

Figure 27:
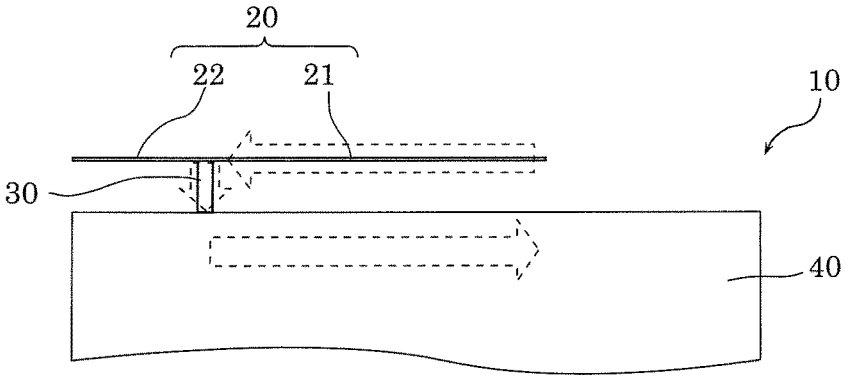
FIG. 27 is a side view illustrating an example of a current path in the multiband compatible antenna according to Embodiment 1.

The effects of multiband compatible antenna 610 according to the embodiment will be described with reference to drawings while comparing with multiband compatible antenna 10 according to Embodiment 1. FIG. 27 is a side view illustrating an example of a current path in multiband compatible antenna 10 according to Embodiment 1. In FIG. 27, an outline of the path of current flowing from planar conductor 20 to chassis 40 is indicated by dashed arrows.

In multiband compatible antenna 10 according to Embodiment 1, for example, when current flows from first element portion 21 to chassis 40, the current flows from first element portion 21 through chassis 40 mainly in the longitudinal direction via short circuit element 31 (not illustrated in FIG. 27) as illustrated in FIG. 27. This current flowing in the longitudinal direction of chassis 40 greatly contributes especially to radiation efficiency at the first frequency. For this reason, as indicated by the arrows in FIG. 27, the direction of current flowing through first element portion 21 and the direction of current flowing through chassis 40 are opposite. Therefore, a magnetic field generated by the current flowing through first element portion 21 cancels out a magnetic field generated by the current flowing through chassis 40.

On the other hand, in multiband compatible antenna 610 according to the embodiment, current flows from planar conductor 20*a* to chassis 40 as indicated by the dashed arrows in FIG. 26. Also in the embodiment, the current flows through chassis 40 mainly in the longitudinal direction (horizontal direction in FIG. 26). However, at least part of first element portion 21*a* is bent in the direction intersecting with the longitudinal direction of chassis 40 as illustrated in side view (b) of FIG. 26. Accordingly, at least part of the direction of the current flowing through first element portion 21*a* is different from the direction of the current flowing through chassis 40. For this reason, a magnetic field generated by the current flowing through first element portion 21*a* can be prevented from cancelling out the magnetic field generated by the current flowing through chassis 40. Consequently, multiband compatible antenna 610 according to the embodiment can increase radiation efficiency as compared to multiband compatible antenna 10 according to Embodiment 1.

As described above, in multiband compatible antenna 610 according to the embodiment, planar conductor 20*a* has a bent shape when viewed from the second direction.

Thereby, it can be prevented or reduced that an electromagnetic wave generated by the current flowing through first element portion 21*a* attenuates due to an electromagnetic wave generated by the current flowing through chassis 40. Therefore, multiband compatible antenna 610 can increase radiation efficiency as compared to multiband compatible antenna 10 according to Embodiment 1.

In multiband compatible antenna 610, at least part of first element portion 21*a* extends in the direction intersecting with the longitudinal direction of chassis 40.

This can prevent the magnetic field generated by the current flowing through first element portion 21*a* from cancelling out the magnetic field generated by the current flowing through chassis 40. Thus, multiband compatible antenna 610 can increase radiation efficiency.

In multiband compatible antenna 610, chassis 40 has corner portion 41 and planar conductor 20*a* has a shape bent along corner portion 41.

In this case, at least part of planar conductor 20*a* extends in the direction intersecting with the longitudinal direction of chassis 40. Therefore, multiband compatible antenna 610 can increase radiation efficiency.

Embodiment 8

A multiband compatible antenna according to Embodiment 8 will be described. In the embodiment, a configuration example of the multiband compatible antenna when mounted on a radio communication device or the like is shown. Hereinafter, the multiband compatible antenna according to the embodiment will be described with reference to drawings focusing on the difference from the multiband compatible antenna according to Embodiment 3.

[8-1. Overall Configuration]

Figure 28:
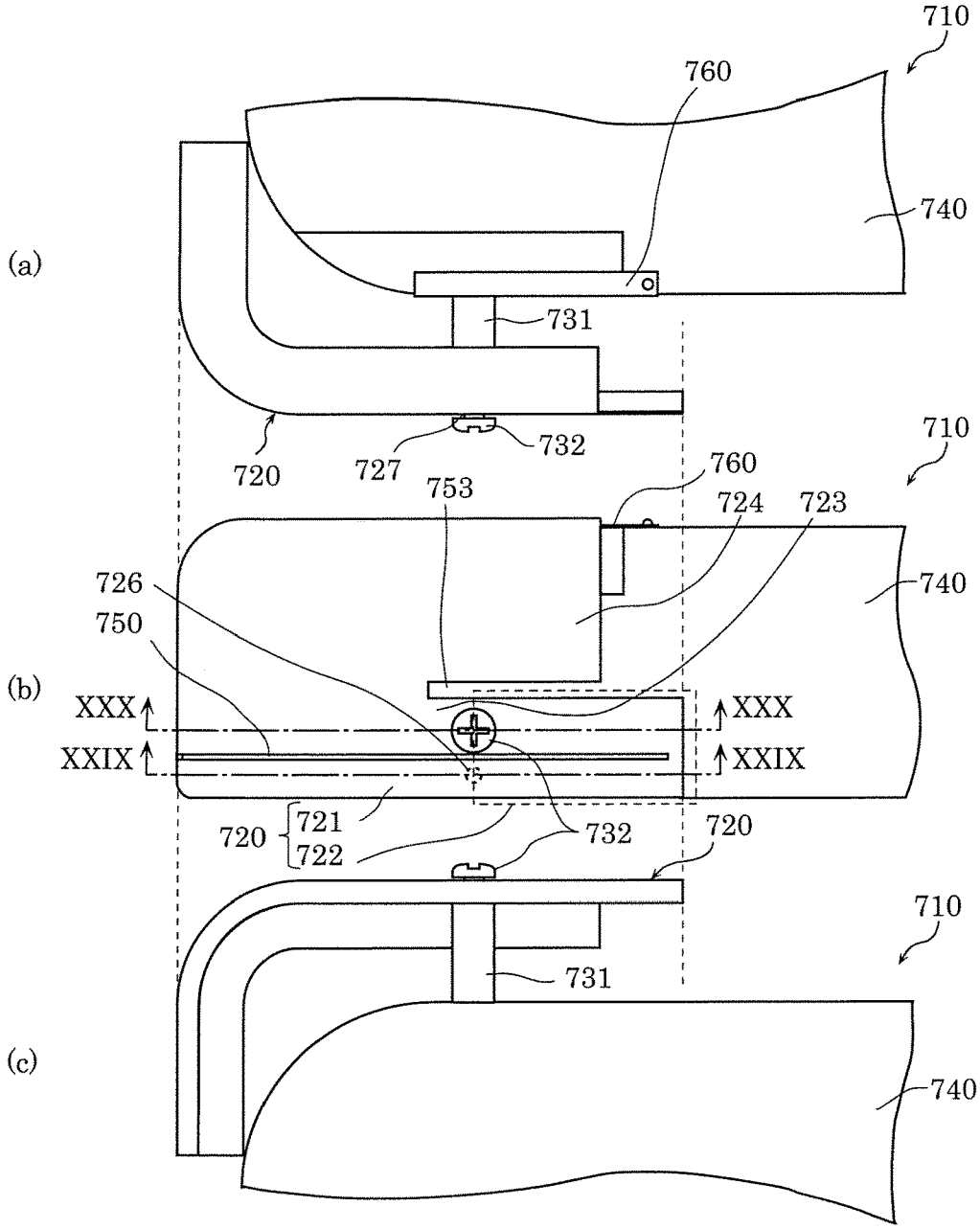
FIG. 28 is a diagram illustrating the shape of a multiband compatible antenna according to Embodiment 8.
Figure 29:
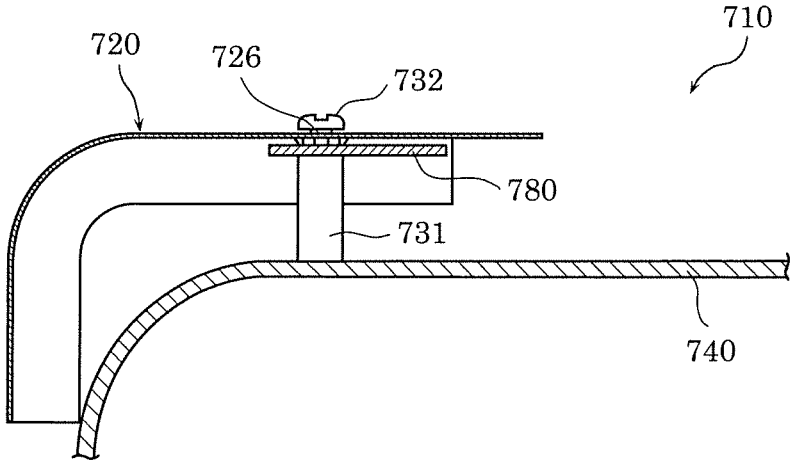
FIG. 29 is a first sectional view of the multiband compatible antenna according to Embodiment 8.
Figure 30:
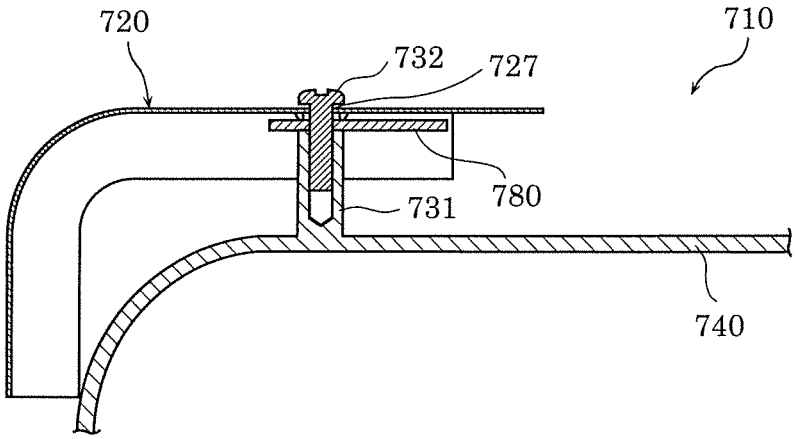
FIG. 30 is a second sectional view of the multiband compatible antenna according to Embodiment 8.
Figure 31:
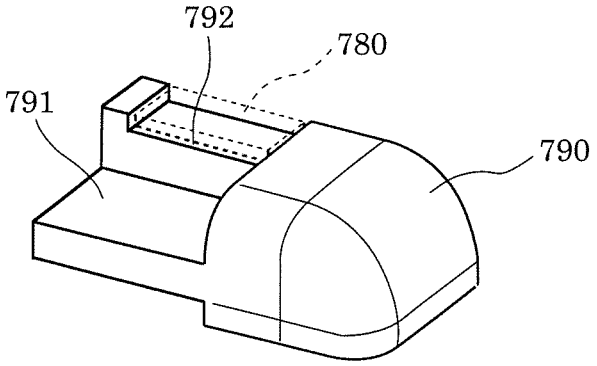
FIG. 31 is an external view illustrating the shape of a dielectric member of the multiband compatible antenna according to Embodiment 8.

FIG. 28 is a diagram illustrating the configuration of multiband compatible antenna 710 according to the embodiment. FIG. 28 illustrates one side view (a), top view (b), and other side view (c) of multiband compatible antenna 710. FIG. 29 and FIG. 30 are first and second sectional views of multiband compatible antenna 710 according to the embodiment, respectively. FIG. 29 and FIG. 30 illustrate an XXIX-XXIX cross section and an XXX-XXX cross section in FIG. 28, respectively. FIG. 31 is an external view illustrating the shape of dielectric member 790 of multiband compatible antenna 710 according to the embodiment.

Multiband compatible antenna 710 according to the embodiment resonates at the first frequency and the second frequency higher than the first frequency in the same manner as multiband compatible antenna 210 according to Embodiment 3. As illustrated in FIG. 28, multiband compatible antenna 710 includes planar conductor 720, short circuit element 731, chassis 740, and ground wire 760 in the same manner as multiband compatible antenna 210 according to Embodiment 3. Multiband compatible antenna 710 further includes conductive screw 732 and circuit board 780 as illustrated in FIG. 29 and FIG. 30. In addition, multiband compatible antenna 710 according to the embodiment further includes dielectric member 790 illustrated in FIG. 31 although illustration thereof is omitted in FIGS. 28, 29, and 30.

As illustrated in FIG. 28, planar conductor 720 is a planar conductor that includes feeding portion 726 to which a signal is supplied and grounding portion 727 which is grounded, and has slit 750 formed between feeding portion 726 and grounding portion 727.

Planar conductor 720 includes first element portion 721 extending toward one side from a straight line passing through feeding portion 726 and grounding portion 727 and second element portion 722 extending toward the other side from the straight line.

As illustrated in FIG. 30, short circuit element 731 is a conductive member that is short-circuited to chassis 740 and has a screw hole formed. Into the screw hole of short circuit element 731, conductive screw 732 is screwed via through-holes that are formed through grounding portion 727 of planar conductor 720 and circuit board 780. Thereby, planar conductor 720 is short-circuited to chassis 740.

Feeding portion 726 of planar conductor 720 is supplied with power from a feeding element (not illustrated) formed on circuit board 780. A signal is supplied to circuit board 780 from the outside via, for example, coaxial cable.

Ground wire 760 is a long plate-like conductive member and is connected to a side of chassis 740.

First element portion 721 is branched at the grounding portion 727-side relative to slit 750 into non-open portion 723 where grounding portion 727 is disposed and open portion 724 forming an open end with branching slit 753.

As illustrated in FIG. 29 and FIG. 30, planar conductor 720 has a bent shape in first element portion 721, and is disposed at a corner portion of chassis 740. In the corner portion, a larger distance can be secured between chassis 740 and planar conductor 720 than an end extending in the long side direction and an end extending in the short side direction of chassis 740. Thereby, the distance between first element portion 721 and chassis 740 can be secured while preventing increase in the dimensions of multiband compatible antenna 710. In the embodiment, the distance between first element portion 721 and chassis 740 can be made larger than the distance between second element portion 722 and chassis 740. Therefore, high radiation efficiency can be obtained at the first frequency with a longer wavelength.

Dielectric member 790 illustrated in FIG. 31 is a member that is disposed between planar conductor 720 and chassis 740 for preventing a housing from deforming at a time of impact on a radio communication device including such a multiband compatible antenna. Dielectric member 790 has concave portion 791 and concave portion 792 formed. Concave portion 791 is a thinned portion formed on a surface facing planar conductor 720 and reduces an impact of dielectric member 790 on the current flowing through planar conductor 720. By forming concave portion 791, decrease in radiation efficiency due to dielectric member 790 can be suppressed. Concave portion 792 is a notch for arranging circuit board 780. Material for forming dielectric member 790 is not specifically limited as long as it is an insulating material, but, for example, resin such as ABS resin or polycarbonate can be used.

[8-2. Summary]

As described above, multiband compatible antenna 710 according to the embodiment includes dielectric member 790 disposed between planar conductor 720 and chassis 740.

Thereby, the deformation of planar conductor 720 can be prevented.

In multiband compatible antenna 710, dielectric member 790 may include concave portion 791 on the surface facing planar conductor 720.

Thereby, decrease in radiation efficiency due to dielectric member 790 can be suppressed.

OTHER EMBODIMENTS

As above, the embodiments and the variations are described as the exemplification of the technique in the present disclosure. For that purpose, the accompanying drawings and the detailed description are provided.

Therefore, the components described in the accompanying drawings and the detailed description may include not only components essential for solving the problem but also components not essential for solving the problem but described for exemplifying the technique. Accordingly, by only the reason that those unessential components are described in the accompanying drawings or the detailed description, those unessential components should not be immediately authorized as essentials.

Since the above-described embodiments and variations are for exemplifying the technique in the present disclosure, various modifications, replacements, additions, omissions, and the like can be performed within the scope of the claims or their equivalents. It is also possible to create a new embodiment by combining components described in the above-described embodiments and variations.

Figure 32:
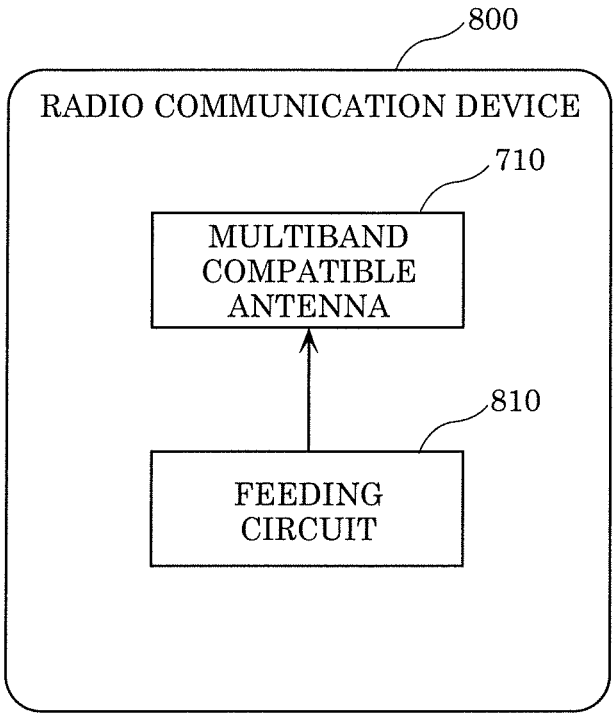
FIG. 32 is a block diagram illustrating an outline of the functional configuration of a radio communication device according to a variation.

For example, one aspect of the disclosure can be embodied also as a radio communication device. FIG. 32 is a block diagram illustrating an outline of the functional configuration of radio communication device 800 according to the variation. Radio communication device 800 illustrated in FIG. 32 includes multiband compatible antenna 710 according to Embodiment 8 and feeding circuit 810 that supplies a signal to multiband compatible antenna 710. As a result, a small radio communication device including a multiband compatible antenna having high radiation efficiency can be embodied. Note that radio communication device 800 may have any functions other than the radio communication function. That is, radio communication device 800 includes any electronic apparatus with the radio communication function.

Also in Embodiments 1-7, a dielectric member may be disposed between the planar conductor and the chassis in the same manner as Embodiment 8.

In the above embodiments, an L-shape is adopted for the slit, but it is not limited to this. For example, the second slit portion may be not necessarily connected to the end of the first slit portion. For example, the second slit portion may be connected to a position closer to the center by approximately 5% of the effective wavelength corresponding to the first frequency from the end of the first slit portion. In this case, the length of a part obtained by removing from the first slit portion a part from a position connected to the second slit portion to the end of the first slit portion may be handled as the effective wavelength of the first slit portion. That is, the electrical length of the slit in the first element portion may not include the electrical length of the part from the position connected to the second slit portion to the end of the first slit portion in the first slit portion.

In the above embodiments, the planar conductor is exposed but may be covered with resin or the like. Thereby, the planar conductor can be protected.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to radio communication devices. Specifically, the present disclosure is applicable to cellular phones, smart phones, tablet terminals, laptop computers, wireless LAN routers, and the like.

What is claimed is:

1. A multiband compatible antenna that resonates at a first frequency and a second frequency higher than the first frequency, the multiband compatible antenna comprising:

a planar conductor including a feeding portion to which a signal is supplied, a grounding portion which is grounded, and a slit disposed between the feeding portion and the grounding portion, wherein the slit includes a first slit portion extending in a first direction and a second slit portion extending in a second direction intersecting with the first direction from an end of the first slit portion, the first slit portion is disposed at a position closer to one edge than a center of the planar conductor in the second direction, the feeding portion is disposed to a side of the first slit portion that is closer to the one edge, the planar conductor includes a first element portion that resonates at the first frequency and a second element portion that resonates at the second frequency, a part of the first slit portion is disposed only in the first element portion out of the first element portion and the second element portion, and an other part of the first slit portion is disposed only in the second element portion out of the first element portion and the second element portion, the second slit portion is disposed in the first element portion, and the first slit portion is a continuous slit.

2. The multiband compatible antenna according to claim 1, wherein an electrical length of the slit in the first element portion is at least 0.15 times and at most 0.35 times an effective wavelength corresponding to the first frequency, and an electrical length of the slit in the second element portion is at least 0.15 times and at most 0.35 times an effective wavelength corresponding to the second frequency.

3. The multiband compatible antenna according to claim 1, wherein an electrical length of the slit in the first element portion is at least 0.4 times and at most 0.6 times an effective wavelength corresponding to the second frequency.

4. The multiband compatible antenna according to claim 1, further comprising:

a feeding element that is disposed at the feeding portion and supplies a signal to the planar conductor, wherein the feeding element has a planar shape extending from the feeding portion and along the slit, in the second element portion.

5. The multiband compatible antenna according to claim 1, wherein the first element portion is branched at a grounding portion side relative to the slit, into a non-open portion where the grounding portion is disposed and an open portion that forms an open end.

6. The multiband compatible antenna according to claim 5, further comprising:

a chassis disposed that is spaced apart from the planar conductor and includes a conductive material which is short-circuited to the grounding portion; and a ground wire that is disposed spaced apart from the planar conductor and includes a conductive material which is short-circuited to the chassis, wherein one end of the ground wire is disposed at a position spaced apart from the chassis and closer to the open portion than the feeding portion.

7. The multiband compatible antenna according to claim 1, wherein the other part of the first slit portion in the second element portion is disposed closer to the center than the part of the first slit portion in the first element portion is.

8. The multiband compatible antenna according to claim 1, wherein the planar conductor has a bent shape when viewed from the second direction.

9. The multiband compatible antenna according to claim 1, further comprising:

a chassis that is long and disposed spaced apart from the planar conductor and includes a conductive material which is short-circuited to the grounding portion; and a short circuit element that short-circuits the grounding portion and the chassis.

10. The multiband compatible antenna according to claim 9, wherein at least part of the first element portion extends in a direction intersecting with a longitudinal direction of the chassis.

11. The multiband compatible antenna according to claim 9, wherein the chassis has a corner portion, and the planar conductor has a shape bent along the corner portion.

12. The multiband compatible antenna according to claim 9, further comprising:

a dielectric member disposed between the planar conductor and the chassis.

13. The multiband compatible antenna according to claim 12, wherein the dielectric member has a concave portion on a surface facing the planar conductor.

14. A radio communication device, comprising:

the multiband compatible antenna according to claim 1; and a feeding circuit that supplies a signal to the multiband compatible antenna.

15. The multiband compatible antenna according to claim 1, wherein a width of the first slit portion is the same as a width of the second slit portion.

16. The multiband compatible antenna according to claim 1, wherein the width of the first slit portion is the same over the length of the first slit portion, and the width of the second slit portion is the same over the length of the second slit portion.

17. The multiband compatible antenna according to claim 1, wherein the first slit portion is disposed between the feeding portion and the grounding portion in the second direction.

* * * * *